US008491390B2

(12) United States Patent
Cregan

(10) Patent No.: US 8,491,390 B2
(45) Date of Patent: Jul. 23, 2013

(54) GAMING SYSTEM AND METHOD HAVING PROGRESSIVE FREE GAMES

(75) Inventor: Karen Michelle Cregan, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/242,010

(22) Filed: Sep. 23, 2011

(65) Prior Publication Data

US 2012/0015712 A1 Jan. 19, 2012

Related U.S. Application Data

(62) Division of application No. 11/558,699, filed on Nov. 10, 2006, now Pat. No. 8,033,903.

(51) Int. Cl.
*A63F 9/24* (2006.01)

(52) U.S. Cl.
USPC ..... 463/37

(58) Field of Classification Search
USPC ..... 463/27
See application file for complete search history.

(56) References Cited

U.S. PATENT DOCUMENTS

| | | | |
|---|---|---|---|
| 4,198,052 | A | 4/1980 | Gauselmann |
| 4,448,419 | A | 5/1984 | Telnaes |
| 4,618,150 | A | 10/1986 | Kimura |
| 4,624,459 | A | 11/1986 | Kaufman |
| 4,669,731 | A | 6/1987 | Clarke |
| 4,695,053 | A | 9/1987 | Vazquez, Jr. et al. |
| 4,732,386 | A | 3/1988 | Rayfiel |
| 4,756,531 | A | 7/1988 | DiRe et al. |
| 4,775,155 | A | 10/1988 | Lees |
| 4,838,552 | A | 6/1989 | Hagiwara |
| 4,991,848 | A | 2/1991 | Greenwood et al. |
| 5,085,436 | A | 2/1992 | Bennett |
| 5,116,055 | A | 5/1992 | Tracy |
| 5,205,555 | A | 4/1993 | Hamano |
| 5,209,479 | A | 5/1993 | Nagao et al. |
| 5,275,400 | A | 1/1994 | Weingardt et al. |
| 5,280,909 | A | 1/1994 | Tracy |

(Continued)

FOREIGN PATENT DOCUMENTS

| | | |
|---|---|---|
| AU | 2007203506 | 8/2007 |
| EP | 0 874 337 | 10/1998 |

(Continued)

OTHER PUBLICATIONS

50 Lions Advertisement, written by Aristocrat Technologies, published in Sep. 2004.

(Continued)

*Primary Examiner* — Corbett B Coburn
(74) *Attorney, Agent, or Firm* — Neal, Gerber & Eisenberg LLP

(57) ABSTRACT

A gaming system and method providing a plurality of games, including a first type of game and a second type of game. The gaming system includes a progressive award which includes or is in the form of a progressive number or quantity of plays of the second type of game. The gaming system enables the player to play the first type of game. The gaming system increases the progressive award based on an occurrence of one or more incrementing conditions. Upon an occurrence of a triggering event, the gaming system determines the progressive award to provide to the player and provides the determined award to the player.

18 Claims, 18 Drawing Sheets

U.S. PATENT DOCUMENTS

| | | | |
|---|---|---|---|
| 5,342,047 | A | 8/1994 | Heidel et al. |
| 5,344,144 | A | 9/1994 | Canon |
| 5,393,057 | A | 2/1995 | Marnell, II |
| 5,393,061 | A | 2/1995 | Manship et al. |
| 5,395,111 | A | 3/1995 | Inoue |
| 5,397,125 | A | 3/1995 | Adams |
| 5,407,200 | A | 4/1995 | Zalabak |
| 5,423,539 | A | 6/1995 | Nagao |
| 5,449,173 | A | 9/1995 | Thomas et al. |
| 5,456,465 | A | 10/1995 | Durham |
| 5,476,259 | A | 12/1995 | Weingardt |
| 5,511,781 | A | 4/1996 | Wood et al. |
| 5,536,016 | A | 7/1996 | Thompson |
| 5,560,603 | A | 10/1996 | Seelig et al. |
| 5,564,700 | A | 10/1996 | Celona |
| 5,580,053 | A | 12/1996 | Crouch |
| 5,580,055 | A | 12/1996 | Hagiwara |
| 5,611,535 | A | 3/1997 | Tiberio |
| 5,611,730 | A | 3/1997 | Weiss |
| 5,645,281 | A | 7/1997 | Hesse et al. |
| 5,645,485 | A | 7/1997 | Clapper, Jr. |
| 5,645,486 | A | 7/1997 | Nagao et al. |
| 5,647,798 | A | 7/1997 | Falciglia |
| 5,655,961 | A | 8/1997 | Acres et al. |
| 5,697,843 | A | 12/1997 | Manship et al. |
| 5,702,304 | A | 12/1997 | Acres et al. |
| 5,711,525 | A | 1/1998 | Breeding |
| 5,720,483 | A | 2/1998 | Trinh |
| 5,722,891 | A | 3/1998 | Inoue |
| 5,766,076 | A | 6/1998 | Pease et al. |
| 5,769,716 | A | 6/1998 | Saffari et al. |
| 5,772,506 | A | 6/1998 | Marks et al. |
| 5,772,509 | A | 6/1998 | Weiss |
| 5,775,692 | A | 7/1998 | Watts et al. |
| 5,779,544 | A | 7/1998 | Seeling et al. |
| 5,788,573 | A | 8/1998 | Baerlocher et al. |
| 5,803,460 | A | 9/1998 | Hesse |
| 5,807,172 | A | 9/1998 | Piechowiak |
| 5,810,354 | A | 9/1998 | Banyai |
| 5,823,874 | A | 10/1998 | Adams |
| 5,833,536 | A | 11/1998 | Davids et al. |
| 5,833,537 | A | 11/1998 | Barrie |
| 5,848,932 | A | 12/1998 | Adams |
| 5,851,148 | A | 12/1998 | Brune et al. |
| 5,855,514 | A | 1/1999 | Kamille |
| 5,855,515 | A | 1/1999 | Pease et al. |
| 5,882,261 | A | 3/1999 | Adams |
| 5,885,158 | A | 3/1999 | Torango et al. |
| 5,890,862 | A | 4/1999 | Spiel et al. |
| 5,902,184 | A | 5/1999 | Bennett et al. |
| 5,910,048 | A | 6/1999 | Feinberg |
| 5,911,418 | A | 6/1999 | Adams |
| 5,918,880 | A | 7/1999 | Voigt, IV et al. |
| 5,919,088 | A | 7/1999 | Weiss |
| 5,927,714 | A | 7/1999 | Kaplan |
| 5,935,002 | A | 8/1999 | Falciglia |
| 5,947,820 | A | 9/1999 | Morro et al. |
| 5,951,397 | A | 9/1999 | Dickinson |
| 5,964,463 | A | 10/1999 | Moore, Jr. |
| 5,967,893 | A | 10/1999 | Lawrence et al. |
| 5,971,849 | A | 10/1999 | Falciglia |
| 5,980,384 | A | 11/1999 | Barrie |
| 5,984,781 | A | 11/1999 | Sunaga |
| 5,988,638 | A | 11/1999 | Rodesch et al. |
| 5,988,643 | A | 11/1999 | Awada |
| 5,993,316 | A | 11/1999 | Coyle et al. |
| 5,997,400 | A | 12/1999 | Seelig et al. |
| 5,997,401 | A | 12/1999 | Crawford |
| 6,003,867 | A | 12/1999 | Rodesch et al. |
| 6,004,207 | A | 12/1999 | Wilson, Jr. et al. |
| 6,007,424 | A | 12/1999 | Evers et al. |
| 6,012,982 | A | 1/2000 | Piechowiak et al. |
| 6,012,983 | A | 1/2000 | Walker et al. |
| 6,015,346 | A | 1/2000 | Bennett |
| 6,027,115 | A | 2/2000 | Griswold et al. |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,062,980 | A | 5/2000 | Luciano |
| 6,062,981 | A | 5/2000 | Luciano, Jr. |
| 6,077,162 | A | 6/2000 | Weiss |
| 6,089,976 | A | 7/2000 | Schneider et al. |
| 6,089,977 | A | 7/2000 | Bennett |
| 6,089,978 | A | 7/2000 | Adams |
| 6,089,980 | A | 7/2000 | Gauselmann |
| 6,093,102 | A | 7/2000 | Bennett |
| 6,095,921 | A | 8/2000 | Walker et al. |
| 6,102,400 | A | 8/2000 | Scott et al. |
| 6,102,402 | A | 8/2000 | Scott et al. |
| 6,102,798 | A | 8/2000 | Bennett |
| 6,110,041 | A | 8/2000 | Walker et al. |
| 6,110,043 | A | 8/2000 | Olsen |
| 6,112,122 | A | 8/2000 | Schwardt et al. |
| 6,113,098 | A | 9/2000 | Adams |
| 6,120,377 | A | 9/2000 | McGinnis, Sr. et al. |
| 6,120,378 | A | 9/2000 | Moody et al. |
| 6,126,542 | A | 10/2000 | Fier |
| 6,135,453 | A | 10/2000 | Srichayaporn |
| 6,142,873 | A | 11/2000 | Weiss et al. |
| 6,142,874 | A | 11/2000 | Kodachi et al. |
| 6,146,273 | A | 11/2000 | Olsen |
| 6,155,925 | A | 12/2000 | Giobbi et al. |
| 6,158,741 | A | 12/2000 | Koelling |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,165,070 | A | 12/2000 | Nolte et al. |
| 6,168,520 | B1 | 1/2001 | Baerlocher et al. |
| 6,168,522 | B1 | 1/2001 | Walker et al. |
| 6,168,523 | B1 | 1/2001 | Piechowiak et al. |
| 6,173,955 | B1 | 1/2001 | Perrie et al. |
| 6,174,233 | B1 | 1/2001 | Sunaga et al. |
| 6,174,235 | B1 | 1/2001 | Walker et al. |
| 6,186,894 | B1 | 2/2001 | Mayeroff |
| 6,190,254 | B1 | 2/2001 | Bennett |
| 6,190,255 | B1 | 2/2001 | Thomas et al. |
| 6,200,217 | B1 | 3/2001 | Osawa |
| 6,203,010 | B1 | 3/2001 | Jorasch et al. |
| 6,203,429 | B1 | 3/2001 | Demar et al. |
| 6,203,430 | B1 | 3/2001 | Walker et al. |
| 6,210,277 | B1 | 4/2001 | Stefan |
| 6,220,959 | B1 | 4/2001 | Holmes, Jr. et al. |
| 6,224,482 | B1 | 5/2001 | Bennett |
| 6,224,483 | B1 | 5/2001 | Mayeroff |
| 6,224,484 | B1 | 5/2001 | Okuda et al. |
| 6,227,969 | B1 | 5/2001 | Yoseloff |
| 6,227,971 | B1 | 5/2001 | Weiss |
| 6,231,442 | B1 | 5/2001 | Mayeroff |
| 6,231,445 | B1 | 5/2001 | Acres |
| 6,234,879 | B1 | 5/2001 | Hasegawa et al. |
| 6,234,897 | B1 | 5/2001 | Frohm et al. |
| 6,238,287 | B1 | 5/2001 | Komori et al. |
| 6,241,607 | B1 | 6/2001 | Payne et al. |
| 6,241,608 | B1 | 6/2001 | Torango |
| 6,244,957 | B1 | 6/2001 | Walker et al. |
| 6,251,013 | B1 | 6/2001 | Bennett |
| 6,254,482 | B1 | 7/2001 | Walker et al. |
| 6,261,128 | B1 | 7/2001 | Heim et al. |
| 6,261,177 | B1 | 7/2001 | Bennett |
| 6,261,178 | B1 | 7/2001 | Bennett |
| 6,270,409 | B1 | 8/2001 | Shuster |
| 6,270,411 | B1 | 8/2001 | Gura et al. |
| 6,279,910 | B1 | 8/2001 | deKeller |
| 6,299,165 | B1 | 10/2001 | Nagano |
| 6,302,790 | B1 | 10/2001 | Brossard |
| 6,302,791 | B1 | 10/2001 | Frohm et al. |
| 6,305,686 | B1 | 10/2001 | Perrie et al. |
| 6,309,298 | B1 | 10/2001 | Gerow |
| 6,309,299 | B1 | 10/2001 | Weiss |
| 6,309,300 | B1 | 10/2001 | Glavich |
| 6,311,976 | B1 | 11/2001 | Yoseloff et al. |
| 6,312,331 | B1 | 11/2001 | Tamaki |
| 6,312,334 | B1 | 11/2001 | Yoseloff |
| 6,315,660 | B1 | 11/2001 | DeMar et al. |
| 6,315,662 | B1 | 11/2001 | Jorasch et al. |

6,315,663 B1 11/2001 Sakamoto
6,315,664 B1 11/2001 Baerlocher et al.
6,319,124 B1 11/2001 Baerlocher et al.
6,328,649 B1 12/2001 Randall et al.
6,334,814 B1 1/2002 Adams
6,334,864 B1 1/2002 Amplatz et al.
6,336,859 B2 1/2002 Jones et al.
6,336,860 B1 1/2002 Webb
6,336,862 B1 1/2002 Byrne
6,340,158 B2 1/2002 Pierce et al.
6,346,043 B1 2/2002 Colin et al.
6,347,996 B1 2/2002 Gilmore et al.
6,358,147 B1 3/2002 Jaffee et al.
6,364,314 B1 4/2002 Canterbury
6,364,766 B1 4/2002 Anderson et al.
6,364,768 B1 4/2002 Acres et al.
6,379,245 B2 4/2002 DeKeller
6,386,977 B1 5/2002 Hole
6,394,902 B1 5/2002 Glavich et al.
6,398,218 B1 6/2002 Vancura
6,398,644 B1 6/2002 Perrie et al.
6,413,162 B1 7/2002 Baerlocher et al.
6,419,579 B1 7/2002 Bennett
6,419,583 B1 7/2002 Crumby et al.
6,428,412 B1 8/2002 Anderson et al.
6,439,993 B1 8/2002 O'Halloran
6,443,452 B1 9/2002 Brune
6,454,651 B1 9/2002 Yoseloff
6,461,241 B1 10/2002 Webb et al.
6,464,581 B1 10/2002 Yoseloff et al.
6,467,771 B1 10/2002 deKeller
6,471,208 B2 10/2002 Yoseloff et al.
6,471,591 B1 10/2002 Crumby
6,481,713 B2 11/2002 Perrie et al.
6,491,584 B2 12/2002 Graham et al.
6,494,454 B2 12/2002 Adams
6,517,432 B1 2/2003 Jaffe
6,537,150 B1 3/2003 Luciano et al.
6,537,152 B2 3/2003 Seelig et al.
6,547,242 B1 4/2003 Sugiyama et al.
6,551,187 B1 4/2003 Jaffe
6,558,253 B1 5/2003 DeSimone et al.
6,558,254 B2 5/2003 Baelocher et al.
6,561,900 B1 5/2003 Baerlocher et al.
6,561,904 B2 5/2003 Locke et al.
6,565,436 B1 5/2003 Baerlocher
6,569,016 B1 5/2003 Baerlocher
6,599,193 B2 7/2003 Baerlocher et al.
6,602,137 B2 8/2003 Kaminkow et al.
6,604,740 B1 8/2003 Singer et al.
6,604,999 B2 8/2003 Ainsworth
6,605,002 B2 8/2003 Baerlocher
6,609,971 B2 8/2003 Vancura
6,609,973 B1 8/2003 Weiss
6,612,927 B1 9/2003 Slomiany et al.
6,616,142 B2 9/2003 Adams
6,626,758 B1 9/2003 Parham et al.
6,638,164 B2 10/2003 Randall et al.
6,695,696 B1 2/2004 Kaminkow
6,705,944 B2 3/2004 Luciano
6,712,694 B1 3/2004 Nordman
6,719,291 B1 4/2004 deKeller
6,733,389 B2 5/2004 Webb et al.
6,802,773 B2 10/2004 Moody
6,805,349 B2 10/2004 Baerlocher et al.
6,817,944 B2 11/2004 Kaminkow et al.
6,855,052 B2 2/2005 Weiss et al.
6,866,583 B2 3/2005 Glavich et al.
6,869,360 B2 3/2005 Marks et al.
6,905,406 B2 6/2005 Kaminkow et al.
6,913,532 B2 7/2005 Baerlocher et al.
6,921,335 B2 7/2005 Rodgers et al.
6,955,600 B2 10/2005 Glavich et al.
6,958,013 B2 10/2005 Miereau et al.
7,029,011 B2 4/2006 Strong et al.
7,056,208 B2 6/2006 Cogert
7,056,213 B2 6/2006 Ching et al.
7,056,215 B1 6/2006 Olive
7,066,814 B2 6/2006 Glavich et al.
7,070,502 B1 7/2006 Bussick et al.
7,074,127 B2 7/2006 Cuddy et al.
7,090,500 B1 8/2006 Guttman
7,094,148 B2 8/2006 Baerlocher et al.
7,118,112 B2 10/2006 Kenny et al.
7,121,942 B2 10/2006 Baerlocher
7,156,741 B2 1/2007 Hornik et al.
7,169,042 B2 1/2007 Muir et al.
7,195,243 B2 3/2007 Kenny et al.
7,235,011 B2 6/2007 Randall et al.
7,238,110 B2 7/2007 Glavich et al.
7,258,611 B2 8/2007 Bigelow, Jr. et al.
7,533,886 B2 5/2009 Kenny et al.
7,651,096 B2 1/2010 Friedman
7,670,221 B2 3/2010 Davis et al.
2001/0009865 A1 7/2001 Demar et al.
2001/0054794 A1 12/2001 Cole et al.
2002/0010017 A1 1/2002 Bennett
2002/0025844 A1 2/2002 Casey et al.
2002/0094857 A1 7/2002 Meyer
2002/0175468 A1 11/2002 Kenny et al.
2003/0045345 A1 3/2003 Berman
2003/0054875 A1 3/2003 Marks et al.
2003/0060266 A1 3/2003 Baerlocher
2003/0060272 A1 3/2003 Glavich et al.
2003/0069056 A1 4/2003 Cormack et al.
2003/0073483 A1 4/2003 Glavich et al.
2003/0114209 A1 6/2003 Ritner et al.
2003/0162585 A1 8/2003 Bigelow et al.
2003/0181231 A1 9/2003 Vancura et al.
2003/0203753 A1 10/2003 Muir et al.
2003/0211884 A1 11/2003 Gauselmann
2003/0216166 A1 11/2003 Baerlocher et al.
2003/0236116 A1 12/2003 Marks et al.
2004/0002372 A1 1/2004 Rodgers et al.
2004/0009803 A1 1/2004 Bennett et al.
2004/0023708 A1 2/2004 Kaminkow et al.
2004/0023714 A1 2/2004 Asdale
2004/0033827 A1 2/2004 Gilmore et al.
2004/0038730 A1 2/2004 Suda
2004/0038731 A1 2/2004 Englman
2004/0048644 A1 3/2004 Gerrard et al.
2004/0048649 A1 3/2004 Peterson et al.
2004/0048652 A1 3/2004 Ching et al.
2004/0053666 A1 3/2004 Vancura
2004/0053669 A1 3/2004 Gerrard et al.
2004/0053672 A1 3/2004 Baerlocher
2004/0072612 A1 4/2004 Rodgers et al.
2004/0082374 A1 4/2004 Maya
2004/0087359 A1 5/2004 Cuddy
2004/0137982 A1 7/2004 Cuddy et al.
2004/0147306 A1 7/2004 Randall et al.
2004/0195773 A1 10/2004 Masci et al.
2004/0242313 A1 12/2004 Munoz
2004/0242314 A1 12/2004 Casey
2004/0266517 A1 12/2004 Bleich et al.
2005/0049035 A1 3/2005 Baerlocher et al.
2005/0054429 A1 3/2005 Baerlocher et al.
2005/0060050 A1 3/2005 Baerlocher
2005/0064929 A1 3/2005 Kaminkow et al.
2005/0070354 A1 3/2005 Baerlocher et al.
2005/0075163 A1 4/2005 Cuddy et al.
2005/0096123 A1 5/2005 Cregan et al.
2005/0101372 A1 5/2005 Miereau et al.
2005/0101373 A1 5/2005 Miereau et al.
2005/0119047 A1 6/2005 Olive
2005/0143168 A1 6/2005 Torango
2005/0176488 A1 8/2005 Olive
2005/0192072 A1* 9/2005 Fiden ..... 463/16
2005/0197180 A1 9/2005 Kaminkow et al.
2005/0209004 A1 9/2005 Torango
2005/0233801 A1 10/2005 Baerlocher et al.
2005/0239542 A1 10/2005 Olsen
2005/0266917 A1 12/2005 Glavich et al.
2006/0014584 A1 1/2006 Iida
2006/0063585 A1 3/2006 Cuddy
2006/0068884 A1 3/2006 Baerlocher et al.
2006/0068885 A1 3/2006 Cregan et al.
2006/0073876 A1 4/2006 Cuddy

| | | | |
|---|---|---|---|
| 2006/0084486 | A1 | 4/2006 | Belger et al. |
| 2006/0084493 | A1 | 4/2006 | Pederson et al. |
| 2006/0084494 | A1 | 4/2006 | Belger et al. |
| 2006/0183535 | A1 | 8/2006 | Marks et al. |
| 2006/0246989 | A1 | 11/2006 | Glavich |
| 2007/0010316 | A1 | 1/2007 | Baerlocher et al. |
| 2007/0049372 | A1 | 3/2007 | Olives et al. |
| 2007/0054733 | A1 | 3/2007 | Baerlocher |
| 2007/0060271 | A1 | 3/2007 | Cregan et al. |
| 2007/0060300 | A1 | 3/2007 | Baerlocher |
| 2007/0060314 | A1 | 3/2007 | Baerlocher et al. |
| 2007/0060321 | A1 | 3/2007 | Vasquez et al. |
| 2007/0080497 | A1 | 4/2007 | Kenny et al. |
| 2007/0087809 | A1 | 4/2007 | Baerlocher |
| 2007/0184887 | A1 | 8/2007 | Cannon |
| 2007/0191088 | A1 | 8/2007 | Breckner et al. |
| 2007/0213114 | A1 | 9/2007 | Caspers |
| 2007/0218975 | A1 | 9/2007 | Iddings et al. |
| 2007/0218982 | A1 | 9/2007 | Baerlocher |
| 2008/0012222 | A1 | 1/2008 | Starzec |
| 2008/0039191 | A1 | 2/2008 | Cuddy |
| 2008/0108412 | A1 | 5/2008 | Snow et al. |
| 2008/0237985 | A1 | 10/2008 | Cogert et al. |
| 2010/0216532 | A1 | 8/2010 | Halverson |

FOREIGN PATENT DOCUMENTS

| | | | |
|---|---|---|---|
| EP | 0 926 645 | | 12/1998 |
| EP | 0 981 119 | | 2/2000 |
| EP | 1 513 117 | | 3/2005 |
| GB | 2 148 037 | | 5/1985 |
| GB | 2 191 030 | | 12/1987 |
| GB | 2 322 217 | | 8/1998 |
| GB | 2 353 128 | | 2/2001 |
| JP | 2005-152111 | A | 6/2005 |
| WO | WO 00/32286 | | 6/2000 |
| WO | WO 01/26019 | | 4/2001 |
| WO | WO 2004/025584 | | 3/2004 |
| WO | WO 2005/099425 | | 10/2005 |
| WO | WO 2005099425 | A2 * | 10/2005 |
| WO | WO 2007/030632 | | 3/2007 |

OTHER PUBLICATIONS

Amazing Wins Article, Bally Gaming Systems, written by Strictly Slots, published in Aug. 2005.

Archer's Legend Article, Konami, written by Strictly Slots, published in Feb. 2005.

Asian Princess Article, Aristocrat Technologies, written by Strictly Slots, published in Mar. 2005.

Bally Live Special Global Gaming Expo, written by Bally Gaming Systems, published in 2002.

Catch A Wave Advertisement, written by Sierra Design Group, available prior to Nov. 10, 2006.

Catch A Wave Advertisement, written by IGT, published in 2001.

Catch A Wave Game Description [online] [printed on Feb. 7, 2001]. Retrieved from the Internet at <URL: http://www.igt.com>.

Catch A Wave Game Description, available prior to Nov. 10, 2006.

Cheesy Money Advertisement, written by Atronic Casino Technology, Ltd., published in 2004.

Deep Blue Dollars Article, written by Strictly Slots, published in Jun. 2004.

Dolphin Treasure Advertisement, written by Aristocrat Leisure Industries Pty., Ltd., published in 1996.

Double Diamond Run Advertisement, written by Igt, published prior to Nov. 10, 2006.

Fishin' Buddies Article, written by Strictly Slots, published in Apr. 2001.

Gold Exchange Advertisement, written by Bally Gaming Systems, available prior to Nov. 10, 2006.

Inca Sun Article, written by Strictly Slots, published in Apr. 2002.

Jackpot Party Brochures and Articles, written by WMS Gaming, Inc., published in 1998.

Jazzy Jackpots Game Description, written by Atronic Casino Technology, Ltd., available prior to Nov. 10, 2006.

Kismet Advertisement, written by Atronic Casino Technology, Ltd., published in 2004.

Marshall Fey, Slot Machines, A Pictoral History of the First 100 Years, Liberty Belle Books, 1983, p. 162.

Money In The Bank, written by Strictly Slots, available Jun. 2001.

Spin Til You Win Game Description, written by IGT, published in 1996.

Wild Bear Salmon Run Advertisement, written by IGT, published in 2003.

Third Party Submission in Published Application Under 37 C.F.R. 1.99 filed for U.S. Appl. No. 13/242,010, dated Mar. 19, 2012 (3 pages).

* cited by examiner

FIG. 4

110

| Number of Consecutively Played Wagering Games | | | Free Spins or Free Games | Multiplier |
|---|---|---|---|---|
| 1 | — | 10 | 10 | 1 |
| 11 | — | 20 | 11 | 1 |
| 21 | — | 30 | 12 | 1 |
| 31 | — | 40 | 13 | 1 |
| 41 | — | 50 | 14 | 1 |
| 51 | — | 60 | 15 | 1 |
| 61 | — | 70 | 15 | 2 |
| 71 | — | 80 | 16 | 2 |
| 81 | — | 90 | 17 | 2 |
| 91 | — | 100 | 18 | 2 |
| 101 | — | 110 | 19 | 2 |
| 111 | — | 120 | 20 | 2 |
| 121 | — | 130 | 20 | 3 |
| 131 | — | 140 | 21 | 3 |
| 141 | — | 150 | 22 | 3 |
| 151 | — | 160 | 23 | 3 |
| 161 | — | 170 | 24 | 3 |
| 171 | — | 180 | 25 | 3 |
| 181 | — | 190 | 25 | 4 |
| 191 | — | 200 | 26 | 4 |
| 201 | — | 210 | 27 | 4 |
| 211 | — | 220 | 28 | 4 |
| 221 | — | 230 | 29 | 4 |
| 231 | — | 240 | 30 | 4 |
| 241 | — | 250 | 30 | 5 |

FIG. 8

| Number of Consecutively Played Wagering Games | Free Spins or Free Games Range | Multiplier Range |
|---|---|---|
| 1 — 10 | 5 — 10 | 1 — 3 |
| 11 — 20 | 6 — 11 | 1 — 3 |
| 21 — 30 | 7 — 11 | 2 — 3 |
| 31 — 40 | 9 — 12 | 2 — 4 |
| 41 — 50 | 10 — 13 | 3 — 4 |
| 51 — 60 | 11 — 13 | 2 — 5 |
| 61 — 80 | 12 — 15 | 3 — 5 |
| 81 — 90 | 13 — 16 | 3 — 6 |
| 91 — 100 | 15 — 22 | 5 — 7 |

GAMING SYSTEM AND METHOD HAVING PROGRESSIVE FREE GAMES

PRIORITY CLAIM

This application is a divisional of, and claims priority to and the benefit of, U.S. patent application Ser. No. 11/558,699, filed on Nov. 10, 2006, which issued as U.S. Pat. No. 8,033,903 on Oct. 11, 2011, the entire contents of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machine manufacturers constantly strive to make gaming machines that maximize enjoyment and excitement for players. One way that gaming machine manufacturers can provide excitement for players is to provide large awards. Providing a bonus game in which a player has an opportunity to win potentially large awards or credits in addition to the awards associated with the base game of the gaming machine is one way to enhance player enjoyment and excitement.

Known gaming devices having bonus games employ a triggering event that occurs during play of the base game of the gaming device. The triggering event temporarily stalls or halts the base game play and enables a player to enter a second game, which is the bonus game. The player plays the bonus game, likely receives an award, and returns to the base game.

Bonus games that provide players with large awards or the potential to win large awards are especially attractive to players. One way that gaming device manufacturers provide larger or more frequently occurring awards in slot gaming machines is by providing free spins to a player.

Another way that gaming device manufacturers provide larger awards to players is by using multipliers. A multiplier increases the award amount proportionally to the value of the multiplier. For example, a "2×" multiplier pays twice the normal award value. A "3×" multiplier pays three times the normal award value. A multiplier can substantially increase a player's award.

Another way that gaming device manufacturers provide larger awards is through progressive awards. Progressive awards associated with gaming machines are known. In one form, a progressive award is an award amount which includes an initial amount funded by a casino and an additional amount funded through a portion of each wager made on the progressive gaming machine. For example, 0.1% of each wager placed on the primary game of the gaming machine may be allocated to the progressive award or progressive award fund. The progressive award grows in value as more players play the gaming machine and more portions of the players' wagers are allocated to the progressive award. When a player obtains a winning symbol or symbol combination which results in the progressive award, the accumulated progressive award is provided to the player. After the progressive award is provided to the player, the amount of the next progressive award is reset to the initial value and a portion of each subsequent wager is allocated to the next progressive award. A progressive award may be associated with a single gaming machine or multiple gaming machines which each contribute portions of the progressive award.

There is a continuing need to provide new and different gaming machines and gaming systems as well as new and different ways to provide awards to players including bonus awards.

SUMMARY

The present disclosure provides a gaming system and method providing a plurality of games, including a first game and a second game. In one embodiment, the gaming system includes a progressive award or an accumulated award which includes or is in the form of a progressive number or accumulated quantity of plays of the second type of game. The gaming system enables the player to play the first type of game or the first game. The gaming system increases the progressive or accumulated award based on an occurrence of one or more incrementing conditions. That is, the gaming system increases the number of plays of the second game of the progressive award based on one or more progressive incrementing conditions. Upon an occurrence of a triggering event, the gaming system determines the progressive award to provide to the player and provides the determined award to the player. It should be appreciated that the progressive or accumulated may be incremented by any suitable incrementing condition. Additionally, in one embodiment, the second type of game or second game has an advantage or a characteristic over the first type of game or first game. In one embodiment, the advantage increases or becomes more beneficial as the progressive award increases.

More specifically, in one embodiment, the gaming system includes a first type of game, such as a wagering game, and a second type of game, such as a free game or free spin game. The progressive award is a number of plays of the free games and a multiplier that is applied to the free games. The progressive award increases based on a suitable incrementing condition, such as wagers being placed at the gaming machine. In one embodiment, a percentage or portion of each wager placed at the gaming machine funds the progressive award. The gaming machine includes a triggering event, such as a triggering symbol combination, that triggers the progressive award. It should be appreciated that any suitable event may be the triggering event for the progressive award. The gaming machine enables players to play the wagering game on the gaming machine with a portion of their wagers funding the progressive award. Upon the occurrence of the triggering symbol combination, the gaming machine provides the player with the progressive award in the form of the number of plays of free games of the progressive award with an advantage or characteristic for the free games. In one embodiment, a multiplier is applied to the free games and increases as the progressive award increases.

It should be appreciated that any suitable factor or event may be the incrementing condition for the progressive award. In one embodiment, an event in the primary game such as a symbol combination of the primary game is the incrementing condition for the progressive award. In one embodiment, as more consecutive games of the first type of game are played on the gaming machine, the number of the plays of the second type of game of the progressive award increases. In another embodiment, the incrementing condition is a winning event, such a winning symbol combination generated on a payline, a winning poker hand or a winning way to win. In another embodiment, the incrementing condition is a placement of a side wager.

It should be appreciated that the advantage or characteristic may be any suitable characteristic. In one embodiment, the second type of game is associated with an advantage that increases or is more advantageous as the progressive award increases. For example, the advantage or the characteristic is a multiplier that increases based on one or more incrementing conditions. For example, the multiplier has a base of one and when fifty dollars are wagered on the gaming machine without a triggering of the progressive award, the multiplier increases to two. In one embodiment, the gaming machine includes a plurality of different advantages and the advantages change based on the incrementing condition. For example, the incrementing condition is the number of consecutive wagering games played. Upon an occurrence of a triggering event, if 1 to 20 consecutive wagering games have been played on the gaming machine, the advantage is three extra bonus symbols in the second type of game for the first 20 games, and if 21 to 40 consecutive wagering games have been played, the advantage is a multiplier of two.

It should be appreciated that the second game may be the same or different than the first game. In another embodiment, the gaming system includes a plurality of games including a first type of game and a second type of game. The gaming system enables the player to play the first type of game. Upon an occurrence of a triggering event associated with the first type of game, the gaming system determines the number of the first type of game consecutively played by the player. The gaming system then provides the player a number of plays of the second type of game based on the number of the first type of game consecutively played by the player. Additionally, in one embodiment, the second type of game has an advantage over the first type of game. In one embodiment, the advantage is based on the number of the first type of game consecutively played by the player before the occurrence of the triggering event.

More specifically, in one embodiment, the first type of game is a wagering game and the second type of game is a free spin or free game. The advantage of the second type of game is a modifier, such as a multiplier. In one embodiment, upon a triggering event associated with the wagering game, the gaming machine or gaming system determines how many wagering games have been played by that player at that gaming machine since last providing that player with one or more free games. The gaming system provides the player a number of plays of free games and a multiplier based on the number of wagering games played since the player began playing the gaming machine or since the player last won a free game. That is, the number of plays of the free games provided to a player is based on the number of consecutively played wagering games. In one embodiment, the number of plays of free games provided to the player and/or the modifier increase as the number of consecutively played wagering games increases.

For example, in one embodiment, the first type of game is a wagering slot game and the second type of game is a free slot game. The gaming machine displays a slot game to a player. The slot game is associated with a triggering event. In this example, the triggering event is the generation of the symbol combination 7-7 on a payline in a five-reel slot game. Upon the generation of the symbol combination 7-7 in one of the played wagering slot games, the gaming machine provides the player a designated number of free slot games based on the number of consecutively played wagering slot games. In one embodiment, the gaming machine provides the player a multiplier to be applied to each of the free slot games. In one embodiment, the multiplier is based on the number of consecutively played wagering slot games.

It should be appreciated that the gaming machine may enable the player to play the free games in any suitable manner. In one embodiment, the gaming machine automatically initiates one of the free games in the next play of the gaming machine. In another embodiment, the gaming machine enables the player to determine whether to save the free games to play at a later time or to immediately play the free games.

In another embodiment, a gaming machine includes a plurality of games. The first type of game is a base game and the second type of game is a bonus game. Upon a triggering event or a bonus game triggering event, the gaming machine or gaming system determines the number of base games the player has played since the player received a bonus game. The gaming machine or gaming system determines the number of bonus games to provide a player based on how many base games the player consecutively played. The gaming machine or system provides the determined number of bonus games to the player. In one embodiment, the bonus games include one or more advantages for the player over the base games, such as a higher paytable or a multiplier. In one embodiment, the amount of the advantage or which advantage is associated with the bonus game is based on the number of consecutively played base games that do not trigger a bonus game.

In another embodiment, a gaming system determines the number of plays of the second type of games to provide to a player based on the number consecutively played first games played by all players of the gaming system. A gaming system includes a plurality of games, including a first type of game and a second type of game. The gaming system enables each of a plurality of players to play the first type of game separately on a gaming machine. Upon an occurrence of a triggering event in the first type of game for one of the players, the gaming machine determines the number of first types of games consecutively played by all of the players of the gaming system. The gaming system then provides that triggering player a number of plays of a second type of game based on the number of first types of games consecutively played by all of the players of the gaming system.

For example, Player X, Player A, Player B and Player C are all players of the gaming system. The first type of game is a wagering game, and the second type of game is a free game. Player X wins a play of a free game at a first point in time. Player A, Player B and Player C are all playing wagering games. Player C achieves a triggering event at a second point in time. The gaming system provides Player C a number of plays of free games based on the total number of consecutively played wagering games from the first point in time to the second point in time. That is, the number of plays of the free games provided to Player C is based on the total number of games played by all of the players since Player X played a free game because there were no free games played between Player X playing a free game and Player C triggering a free game.

It should be appreciated that the first type of game and the second type of game may be the same games or may be different games. The games may be any suitable kind of game, such as, but not limited to, slots, poker, bunco, checkers, blackjack, roulette, keno, bingo, craps and any combination of these or any other suitable random game which results in awards.

The first type of games and second type of games may be the same games with the only difference being that the first type of game requires a wager to initiate the game wherein the second type of game may be played after the gaming machine provides it to the player. Additionally, one or more of the first type of games may be different games and one or more of the second type of games may be different games.

The gaming machine may determine the number of plays of the second type of game to provide a player for the occurrence of each triggering event in any suitable manner. In one embodiment, as the number of consecutively played first type of games increases, the number of second type of game provided to the player increases. In one such embodiment, intervals of the first type of game are associated with a certain number of plays of the second type of game. In one embodiment, an interval of consecutively played first type of game (i.e., 1 to 10) is associated with a number of plays of a second type of game. That is, each number of consecutively played games of the first type of game is associated with a specific number of plays of the second type of game. Therefore, the number of plays of the second type of game provided to the player is determined by the number of consecutively played first type of game. In other embodiments, the gaming machine determines the number of first type of games to provide to a player additionally based on other factors, such as how much the player wagered on the first type of game or the another aspect of the triggering first type of game.

In another embodiment, an interval of consecutively played first type of game (i.e., 1 to 10) is associated with a range of numbers of plays of a second type of game (i.e., 3 to 7). That is, each number of consecutively played games of the first type of game is associated with a range of numbers of the second type of game. Therefore, the number of plays of the second type of game provided to the player is partially determined by the number of consecutively played first type of game. In one embodiment, the gaming machine randomly determines which number of games of the range to provide the player. In another embodiment, the gaming machine makes a determination based on a suitable factor, such as the player's ranking, which number of games of the range to provide the player. In another embodiment, the gaming machine provides a predetermined number of games of the range to the player.

In other embodiments, the gaming machine determines the number of first type of games to provide to a player additionally based on other factors, such as how much the player wagered on the first type of game or another aspect of the first type of game.

It should be appreciated that the second type of game may be different than the first type of game in any suitable manner, advantage or characteristic. For example, the second type of game may have a different: (i) paytable than the paytable employed in the first type of game; (ii) volatility than the volatility of the first type of game; (iii) average expected payback percentage than the average expected payback percentage of first type of game; (iv) eligibility for a progressive award than the first type of game; (vi) modifier or multiplier than a multiplier employed by the first type of game; (vii) type or kind of the bonus game or free game; (viii) more paylines or more winning combinations than the first type of game; or (ix) any combination of these. Any of the above factors may be determined based on any suitable factor (i.e., a number of consecutively games played without a bonus game) or may be randomly determined.

Additionally, in one embodiment, as the number of consecutively played first types of games increases, the advantage applied to the second type of game increases. For example, if a player plays from 1 to 10 consecutive wagering games and then achieves a triggering event, the gaming machine provides the player with 10 free spins or free games and a multiplier of 1. If a player plays from 131 to 140 consecutive wagering games and then achieves a triggering event, the gaming machine provides the player with 25 free spins or free games and a multiplier of 3 for the free games.

In another embodiment, the gaming machine includes a plurality of different kinds of second types of games and which second type of game provided to the player is based on a suitable factor, such as the number of games played on the gaming machine. For example, the second types of games of the gaming machine are a slot game, a poker game, a plurality of slot games and a plurality of poker games. If 1 to 10 consecutive first types of games are played on the gaming machine, upon the occurrence of a triggering event, the gaming machine provides the player with a slot game. If 11 to 20 consecutive first types of games are played on the gaming machine, upon the occurrence of a triggering event, the gaming machine provides the player with a poker game. If 21 to 30 consecutive first types of games are played on the gaming machine, upon the occurrence of a triggering event, the gaming machine provides the player with a plurality of slot games. If 31 to 40 consecutive first types of games are played on the gaming machine, upon the occurrence of a triggering event, the gaming machine provides the player with a plurality of poker games.

In another embodiment, the second types of games are the same kind of second type of game and a triggering event awards the player the same number of plays of the second type of game but the second types of games have different features or characteristics. For example, if 1 to 20 consecutive first types of games are played on the gaming machine, upon the occurrence of a triggering event, the gaming machine provides the player with five free spin games which include one bonus symbol. If 21 to 40 consecutive first types of games are played on the gaming machine, upon the occurrence of a triggering event, the gaming machine provides the player with five free spin games which include two bonus symbols. If 41 to 60 consecutive first types of games are played on the gaming machine, upon the occurrence of a triggering event, the gaming machine provides the player with five free spin games which include three bonus symbols. Therefore, as the player plays more consecutive first type of games, the player has a better advantage in the second type of games receives a predetermined or set number of plays of the second type of game. In this example, the player has a better chance of winning a bonus award because there are more bonus symbols.

In one embodiment, instead of awarding a second number of games based on events on a single gaming machine, a player has an account. Upon a triggering event, the player is awarded a number of a second type of game based on information specific to the player. More specifically, in one embodiment, a gaming system includes a player tracking system that monitors and stores the player's gaming activity. At the start of a gaming session, a player logs into a gaming machine to begin a play session. The player tracking session stores information, such as the amount of wagers and the number of games since a last bonus or free game. Upon a triggering event or a triggering event, the gaming machine or system determines a number of plays of the second type of game to provide the player based on the specific information stored in the player tracking system.

It is therefore an advantage of the gaming machine to enable a player to win a second type of game or award opportunity based on a consecutive number of a first type of game played.

It is therefore another advantage of the gaming machine to enable the player to win one or more advantages for a second type of game.

It is another advantage of the gaming machine to enable the player to win one or more progressive awards that include variable numbers of a second type of game.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE FIGURES

FIG. 4 is a table illustrating one embodiment disclosed herein, illustrating different intervals of consecutively played wagering games, wherein each interval is associated with a number of free games and a multiplier.

FIG. 8 is a table illustrating one embodiment disclosed herein, illustrating different intervals of consecutively played wagering games, wherein each interval is associated with a range of numbers of free games and a range of multipliers.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
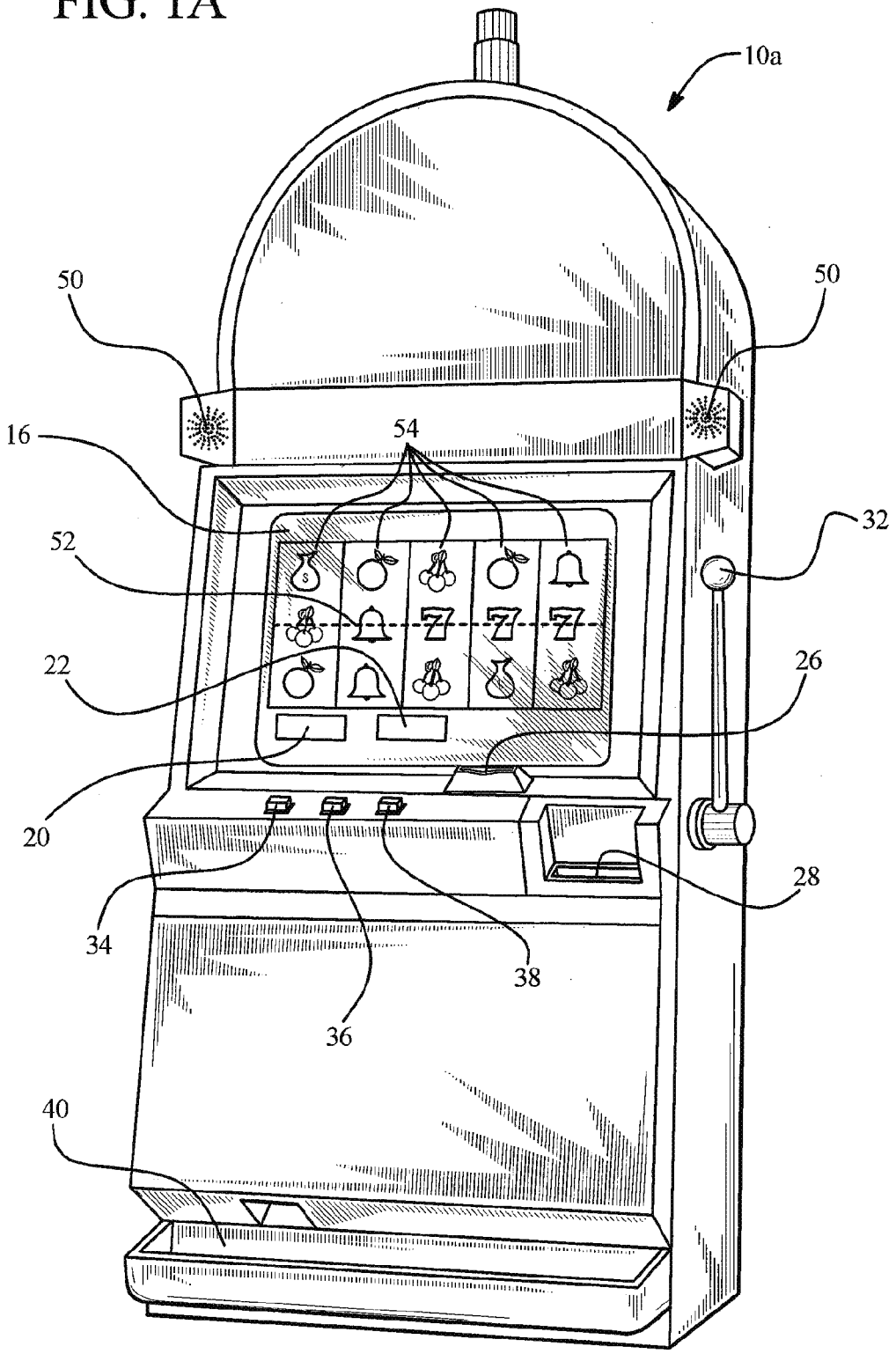
FIGS. 1A and 1B are perspective views of alternative embodiments of the gaming device of the present disclosure.
Figure 1B:
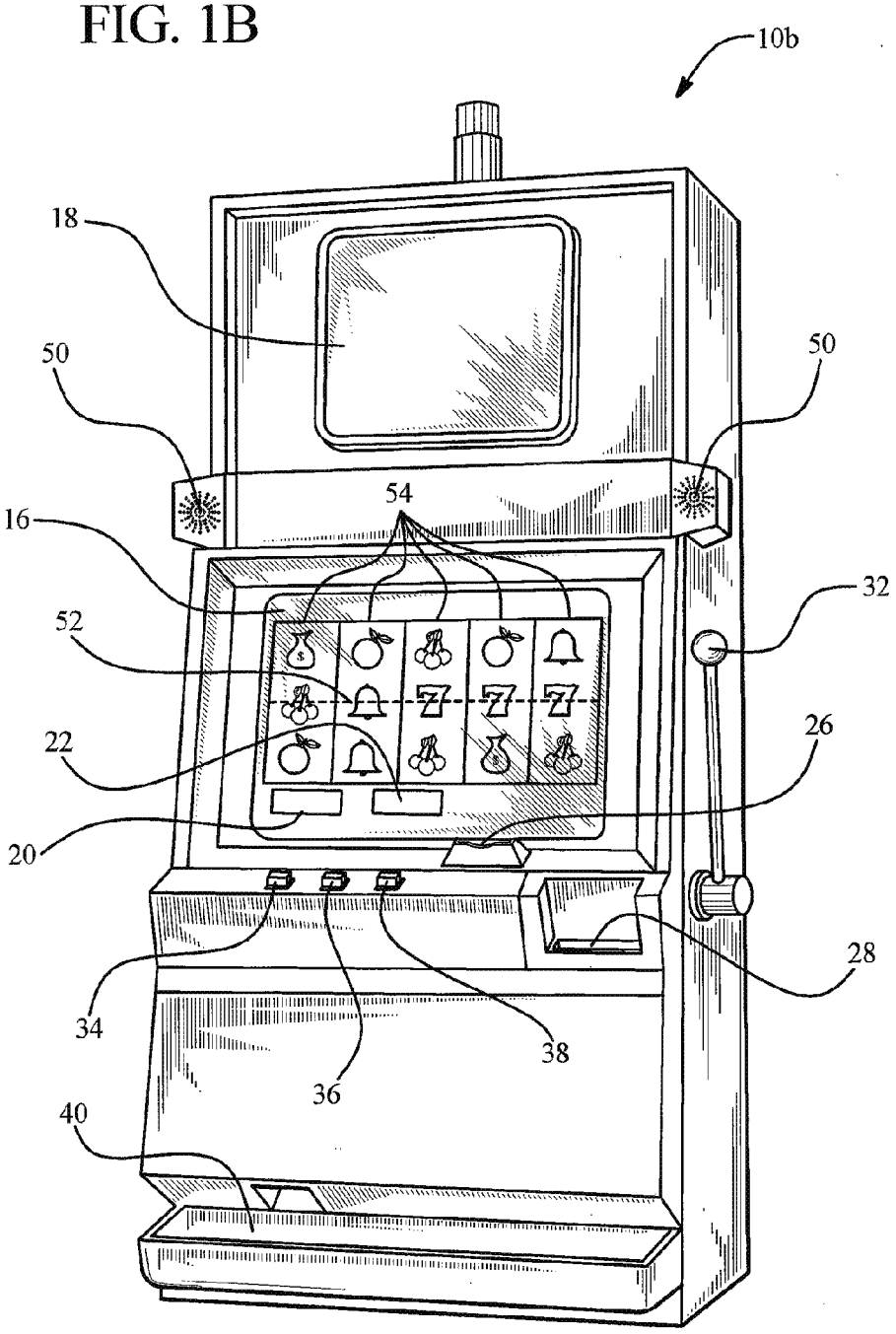

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
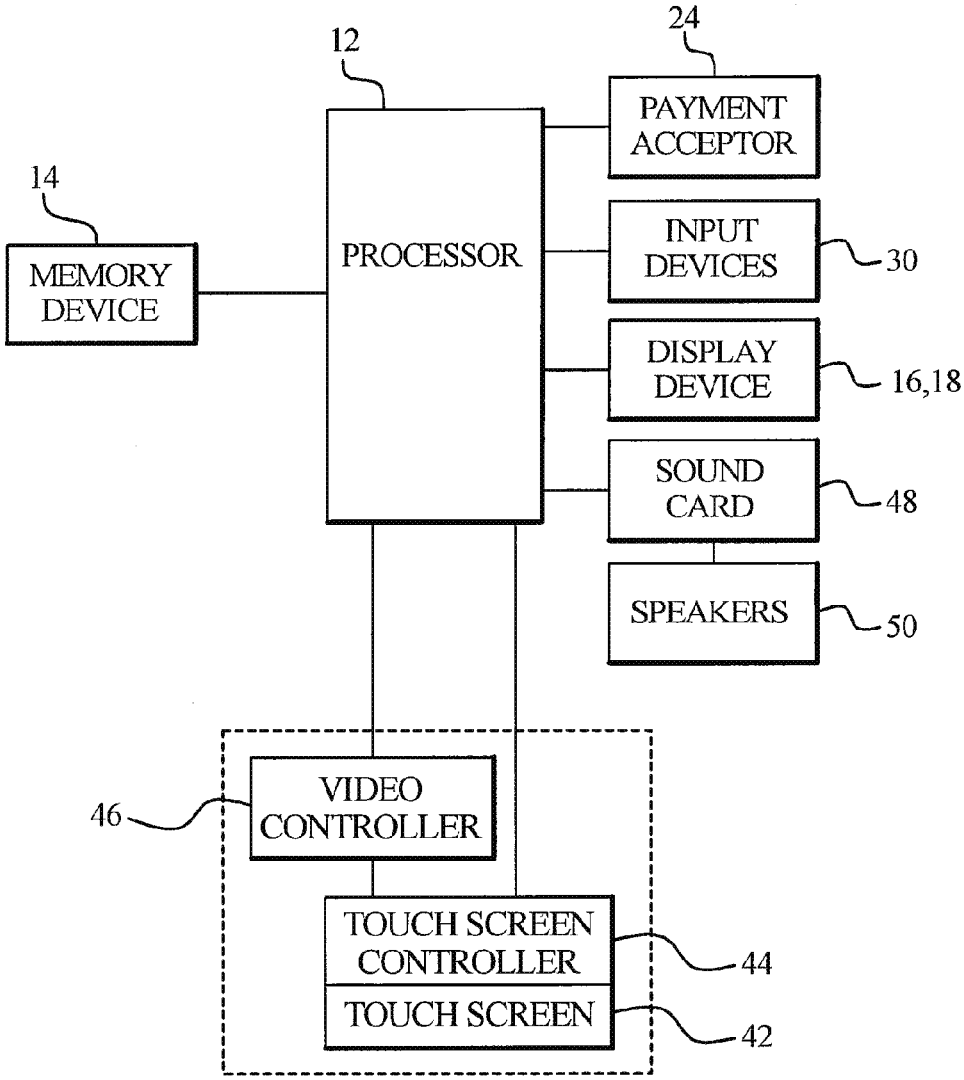
FIG. 2A is a schematic block diagram of the electronic configuration of one embodiment of the gaming device of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission.

The processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a touch-screen button panel. It should be appreciated that the utilization of touch-screens is widespread in the gaming industry.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary game, base game or first type of game. The gaming machine or device may include some or all of the features of conventional gaming machines or devices. The primary game, base game or first type of game may comprise any kind of suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a primary game, base game or first type of game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a primary game, base game or first type of game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the primary game, base game or first type of game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, primary game, base game or first type of game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits or other awards in a primary game, base game or first type of game, the gaming device may also give players the opportunity to win credits in a bonus or secondary game or second type of game or bonus or secondary round. The bonus game, second type of game or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round or second game after the player has achieved a triggering event or qualifying condition in the base or primary game. In another embodiment, after a player has qualified for a bonus game or second game, the player may subsequently enhance his/her bonus game/second game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
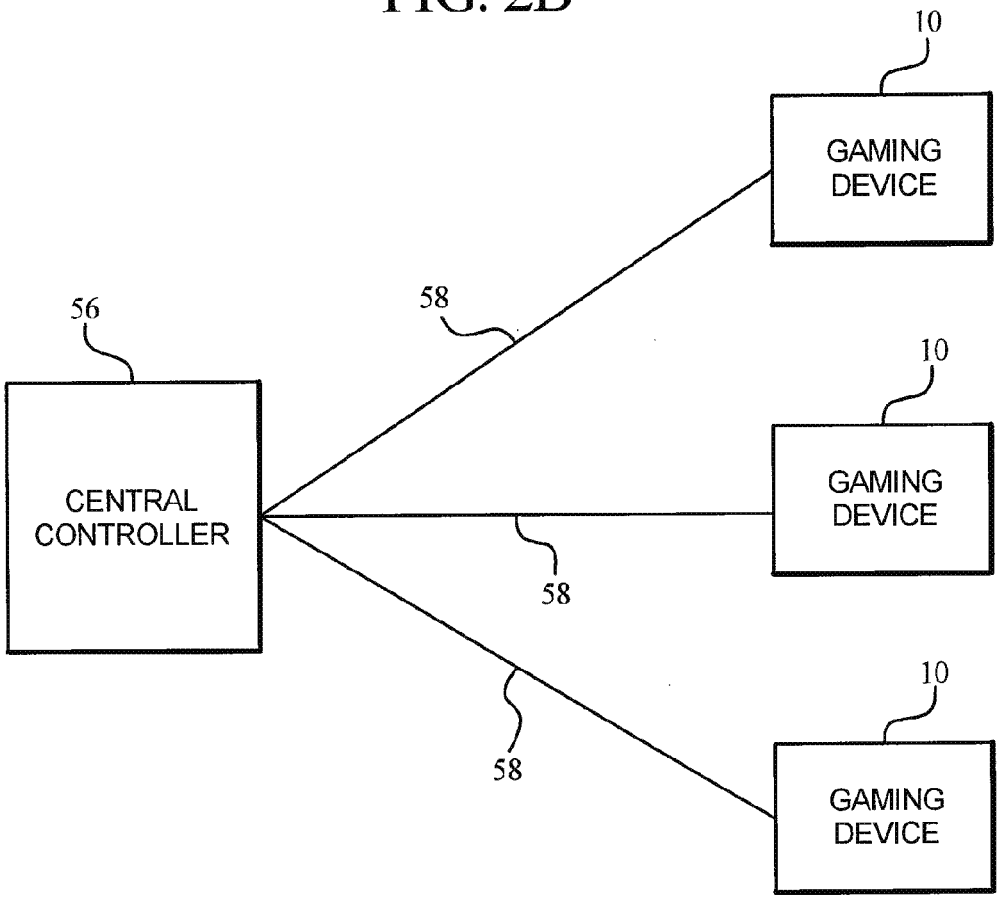
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment insures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Interval Based Free Games or Interval Based Bonus Games

Figure 3:
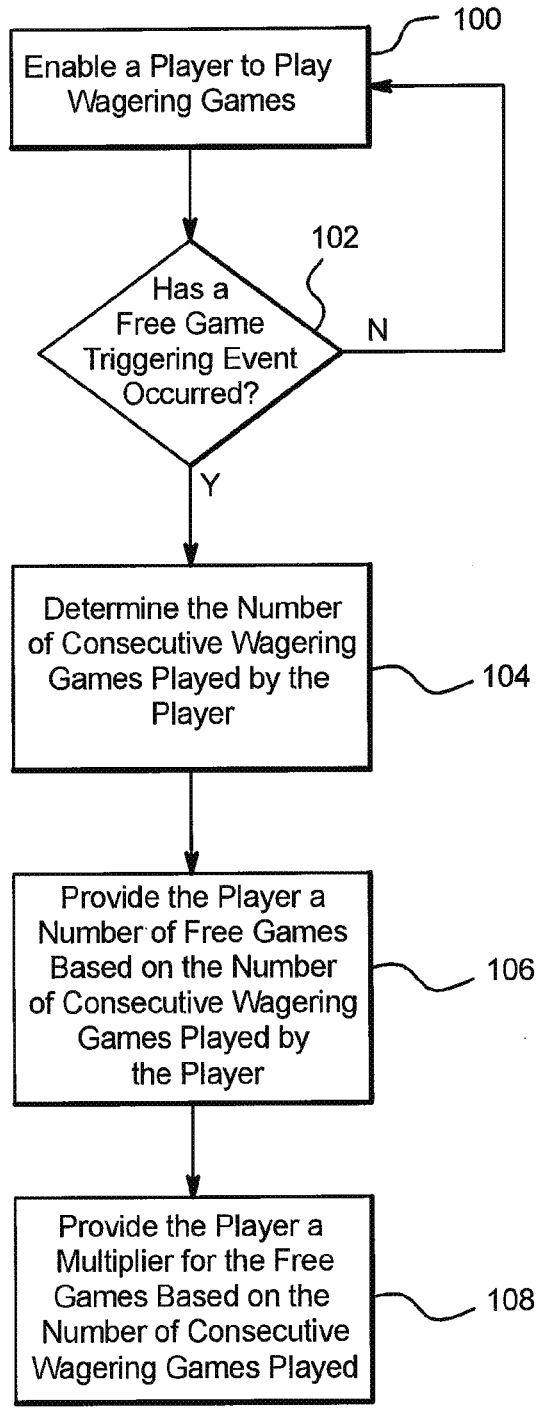
FIG. 3 is a flow chart of the method of one embodiment disclosed herein, illustrating how the gaming machine determines the number of free games to provide to a player based on the number of consecutive wagering games played by that player.

FIG. 3 is a flow chart illustrating one method of the present disclosure. The gaming machine enables a player to play a first type of game or a number of plays of a first game. Upon a triggering event associated with the first type of game or first game, the gaming machine determines a number of a second type of game or plays of the second game to provide to the player. In the illustrated example, the first game is a wagering game and the second game is a free game. As illustrated in block 100, the gaming machine enables the player to play wagering games. The gaming machine determines whether a triggering event has occurred as illustrated in diamond 102. If a triggering event has not occurred, the gaming machine enables the player to continue to play wagering games as illustrated in block 100. If the gaming machine determines that a triggering event has occurred, the gaming machine determines the number of consecutive wagering games played by the player as illustrated in block 104. That is, the gaming machine determines the number of consecutively or continuously played wagering games since either the last free game played by the player or the beginning of play by the player in that gaming session. The gaming machine may determine the number of consecutively played wagering games in any suitable manner. In one embodiment, the gaming machine includes a counter. Upon initiation of a gaming machine, the gaming machine continually counts the games until a player obtains a triggering event. That is, the games are counted regardless of whether a player ever receives a triggering event. In another embodiment, the gaming machine determines the number of consecutively played wagering games by counting the number of consecutively played wagering games after the occurrence of a triggering event. That is, the gaming machine counts the number of consecutively played wagering games played by that player only upon an occurrence of a triggering event. In one embodiment, this is done by accessing the history of plays stored in the memory device. It should be appreciated that the memory device may store any suitable number of plays.

The gaming machine provides the player a number of plays of free games based on the determined number of consecutive wagering games played by that player for that gaming session as illustrated in block 106. In one embodiment, the gaming machine provides the player a modifier, such as a multiplier, for the free games based on the number of consecutively played wagering games as illustrated in block 108. That is, upon an occurrence of a triggering event, the gaming machine provides the player a number of free spins or free games and a multiplier for those games based on the number of consequently played wagering games. It should be appreciated that the gaming machine may provide the player free games and/or a modifier based on the number of consecutively played wagering games. Additionally, the gaming machine may provide the player any other game or a characteristic or an advantage for a game based on the number of consecutively played wagering games.

It should be appreciated that the number of second type of games provided to the player may increase in any suitable manner. In one embodiment, each possible number of consecutively played first types of games is included in an interval and each interval is associated with a certain number of plays of the second type of game. That is, each number of plays of the second type of game is associated with more than one number of consecutively played first types of games.

As illustrated in FIG. 4, in one embodiment, the gaming machine, system or method associates a number of a second type of game and an advantage for a second type of game with an interval of numbers of consecutively played first type of game. In the illustrated example, the first type of game is a wagering game and the second type of games is a free game. The advantage is a multiplier provided for the second types of game. In one embodiment, as the number of consecutively played wagering games increases, the number of plays of free games provided to the player increases. Additionally, in one embodiment, as the number of consecutively played wagering games increases, the multiplier applied to the free games increases.

For example, as illustrated in FIG. 4, if a player plays from 1 to 10 consecutive wagering games and then achieves a triggering event, the gaming machine provides the player with 10 free spins or free games and a multiplier of 1 for each free game. If a player plays from 131 to 140 consecutive wagering games and then achieves a triggering event, the gaming machine provides the player with 21 free spins or free games and a multiplier of 3 for each of the free games. If a player plays from 201 to 210 consecutive wagering games and then achieves a triggering event, the gaming machine provides the player with 27 free spins or free games and a multiplier of 4 for the free games.

In this embodiment, as the number of consecutively played wagering games increases, the average expected amount a player wins increases and the amount a player can ultimately win increases. For example, if in the free games the average expected value provided to a player per game is 95 cents per dollar wagered, the amount on average a player wins increases per free game played. Additionally, when a multiplier is applied to each win, the average amount a player wins per game increases assuming they wager the same amount for each game. For example, on the table of FIG. 4, if a player plays 15 wagering games consecutively and then obtains or achieves a triggering event, the gaming machine provides the player 11 free games and a multiplier of 1 for each free game. Therefore, on average, if the gaming machine calculates the awards as if the player wagered $1 a game, a player on average will win $0.95×11×1 or $8.25 total for the free games. If a player plays 85 wagering games consecutively and then obtains or achieves a triggering event, the gaming machine provides the player 17 free games and a multiplier of 2 for each free game. Therefore, if the gaming machine calculates the awards as if the player wagered $1 a game, a player on average $0.95×17×2 or $32.30 for the free games. Therefore, the gaming machine rewards players that get less frequent free games by providing them with more free games upon a triggering event.

Additionally, the player's award volatility increases as the number of consecutively played wagering games increase. That is, the total amount a player has the possibility of winning increases for each interval of consecutively played free games. For example, on the table of FIG. 4, if a player plays 15 wagering games consecutively and then obtains or achieves a triggering event, the gaming machine provides the player 11 free games and a multiplier of 1 for each free game. Therefore, if the highest award a player may win is $10,000, a player has the possibility of winning 10,000×11×1 or $110,000 if the player plays 11 free games with a multiplier of one for each free game. If a player plays 85 wagering games consecutively and then obtains or achieves a triggering event, the gaming machine provides the player 17 free games and a multiplier of 2 for each free game. Therefore, a player can possibly win 10,000×17×2 or $340,000.

Figure 5:
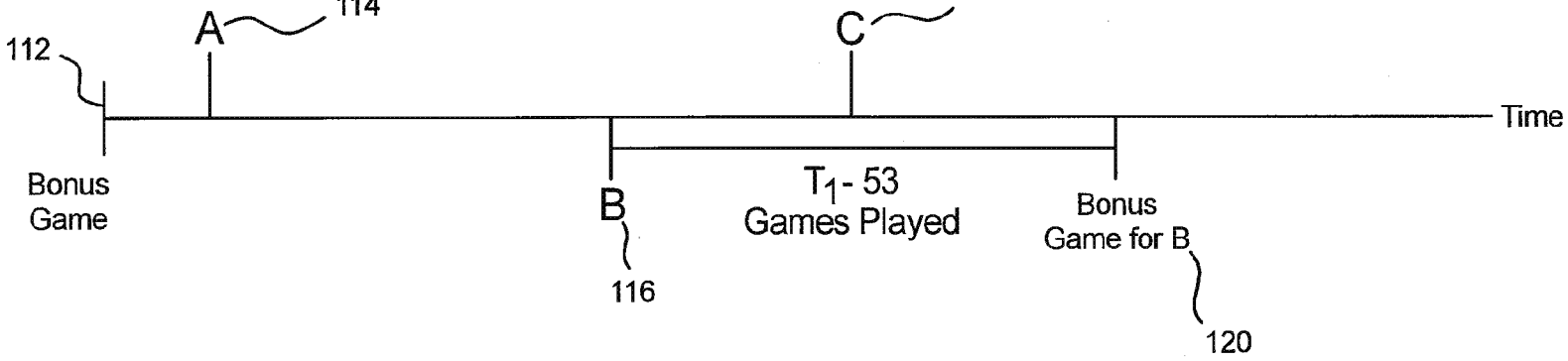
FIG. 5 is a timeline illustrating one embodiment disclosed herein, illustrating how a gaming system determines the number of free games to provide to a player based on the number of consecutive wagering games played by that player.
Figure 6:
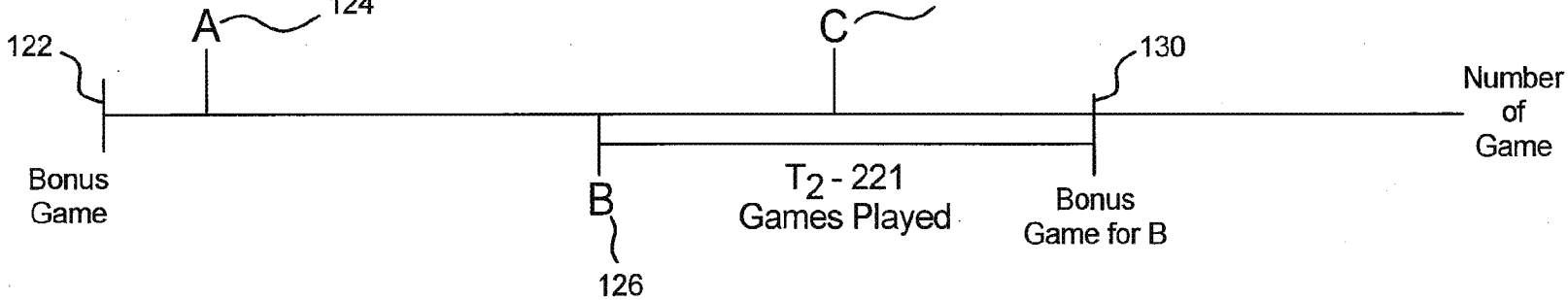
FIG. 6 is a timeline illustrating one embodiment disclosed herein, illustrating how a gaming system determines the number of free games to provide to a player based on the number of consecutive wagering games played by each of the players playing on the gaming system.

FIGS. 5 and 6 illustrate timelines of two different embodiments of the present disclosure.

FIG. 5 represents one embodiment where the gaming machine or gaming system determines a number of a second type of games to provide to a played based on the number of consecutively played first types of games by that player. In the illustrated embodiment, the first type of game is a wagering game and the second type of game is a free game. The gaming machine determines the number of plays of free games based on a number of consecutively wagering games played by that single player. That is, each determination made for free games is individually player based. As illustrated in the FIG. 5, the line represents time. In the gaming system of FIG. 5, at an early point in time 112, a free game was won by Player X. Player A then begins playing wagering games at a later point in time 114. Player B begins playing wagering games at a later point in time 116. Player C then begins playing wagering games at a later point in time 118. At a certain point in time 120, Player B achieves a triggering event. Player B's gaming machine or the gaming system determines the number of games played from the time when Player B started playing wagering games 116 and the time between Player B achieving a triggering event 120. During this time, T1, Player B's gaming machine or the gaming system determines that the player played 53 consecutive wagering games. Therefore, in one example of the table of FIG. 4, the gaming machine would provide the player 15 free games.

In another embodiment, instead of individually counting the consecutive first type of games for the triggering player, a gaming system determines the total number of consecutive first type of games played by all players to determine how many of a second type of game to provide to a player and/or a multiplier to provide to a player. In the illustrated embodiment, the first type of game is a wagering game and the second type of game is a free game. As illustrated in FIG. 6, at an initial time 122, Player X wins a free game. Player A then begins playing wagering games at a later point in time 124. Player B begins playing wagering games at a later point in time 126. Player C then begins playing wagering games at a later point in time 128. At a certain point in time 130, Player B achieves a triggering event. The gaming system determines the number of games played from the time the last free game occurred, which in this example was the time when Player X achieved a triggering event 122 until the time Player B achieved the triggering event 130. During this time, T2, the gaming system determines that all of the players have played a total of 221 consecutive wagering games. Therefore, in one example of the table of FIG. 4, the gaming machine would provide Player B 29 free games, with a multiplier of 4 applied to each of the free games.

Figure 7A:
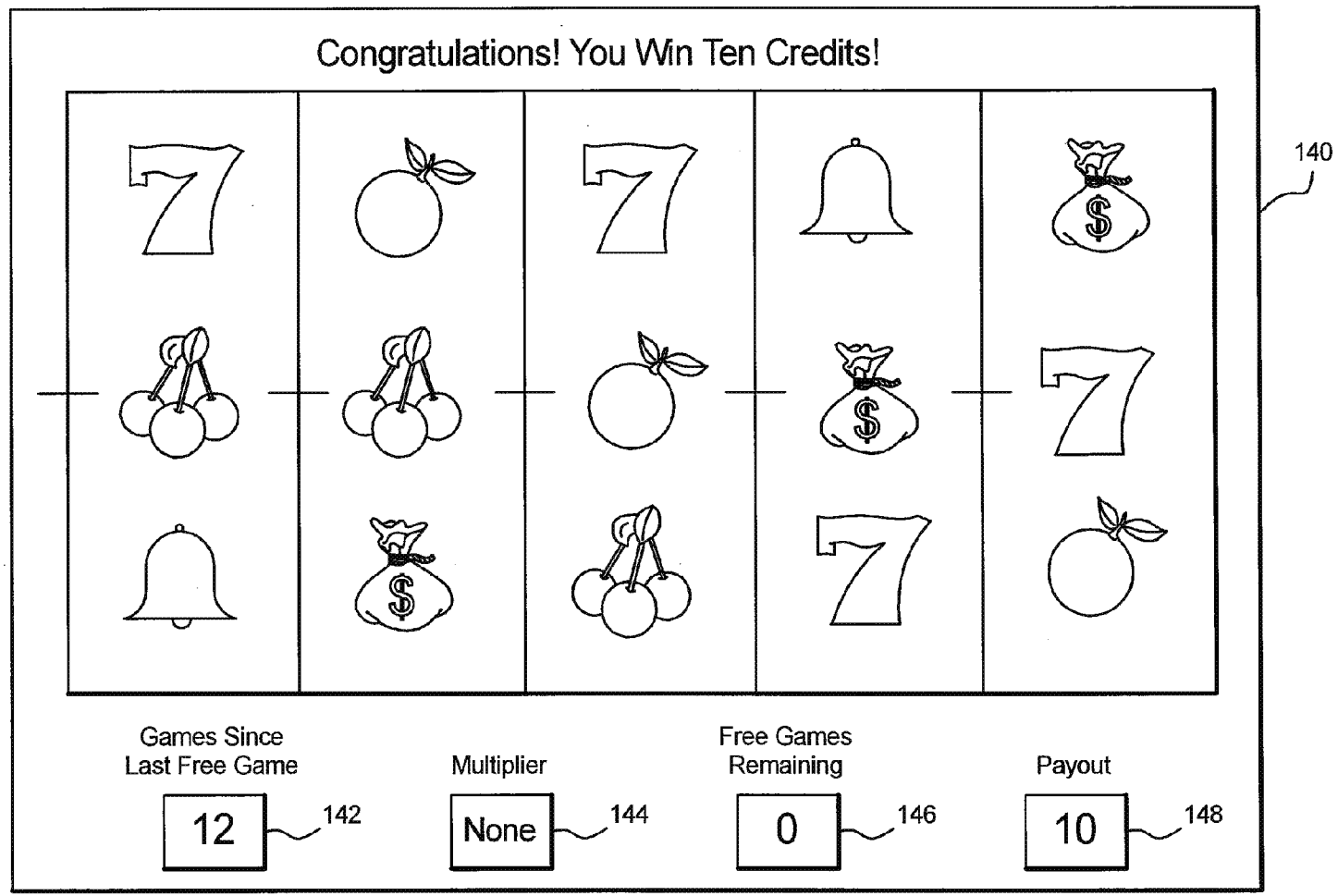
FIGS. 7A, 7B, and 7C, are front views of a display device of one embodiment disclosed herein, illustrating a gaming machine enabling a player to wager on a plurality of games and determining a number of free games and a multiplier to provide to a player upon the occurrence of a triggering event.
Figure 7B:
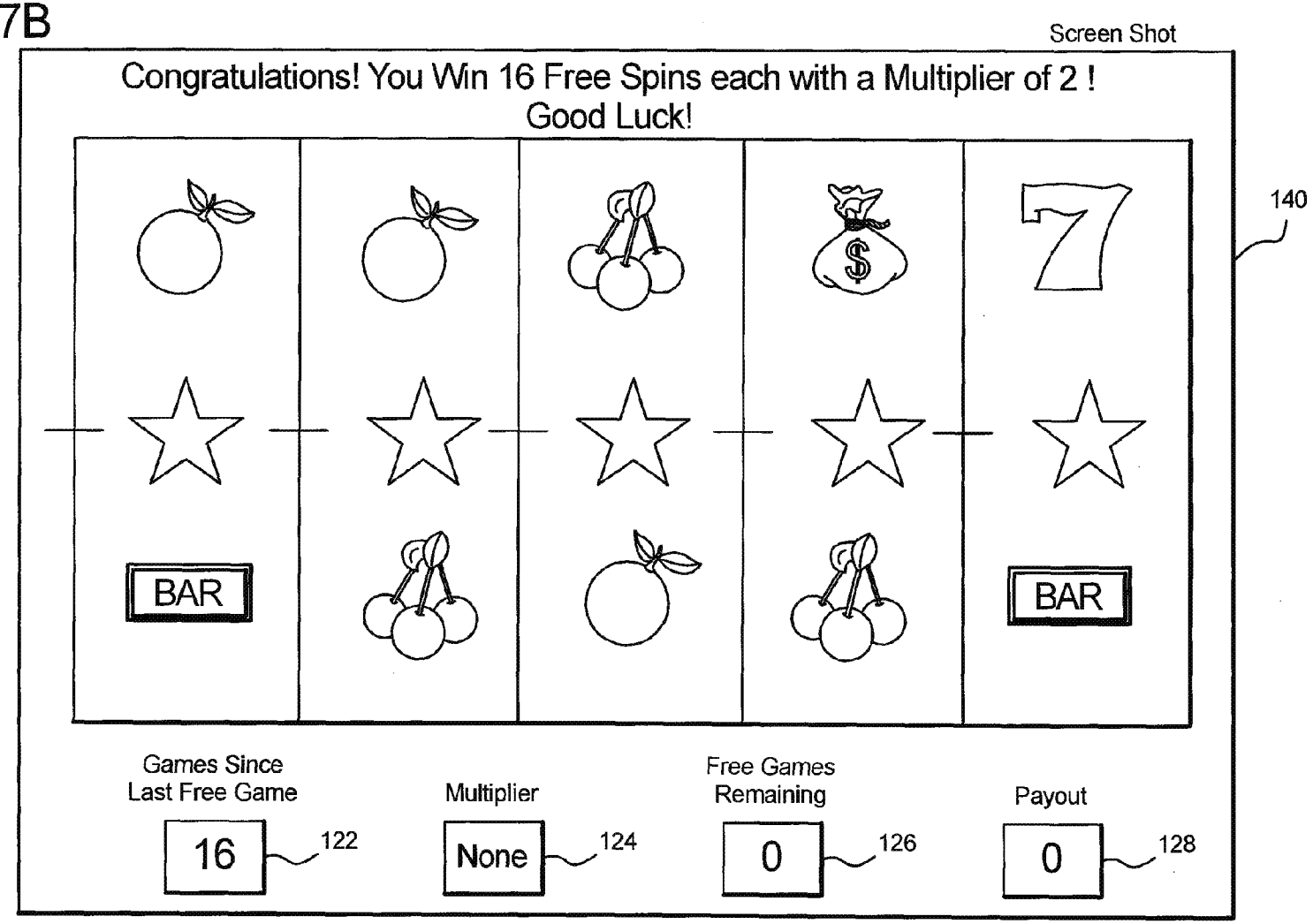
Figure 7C:
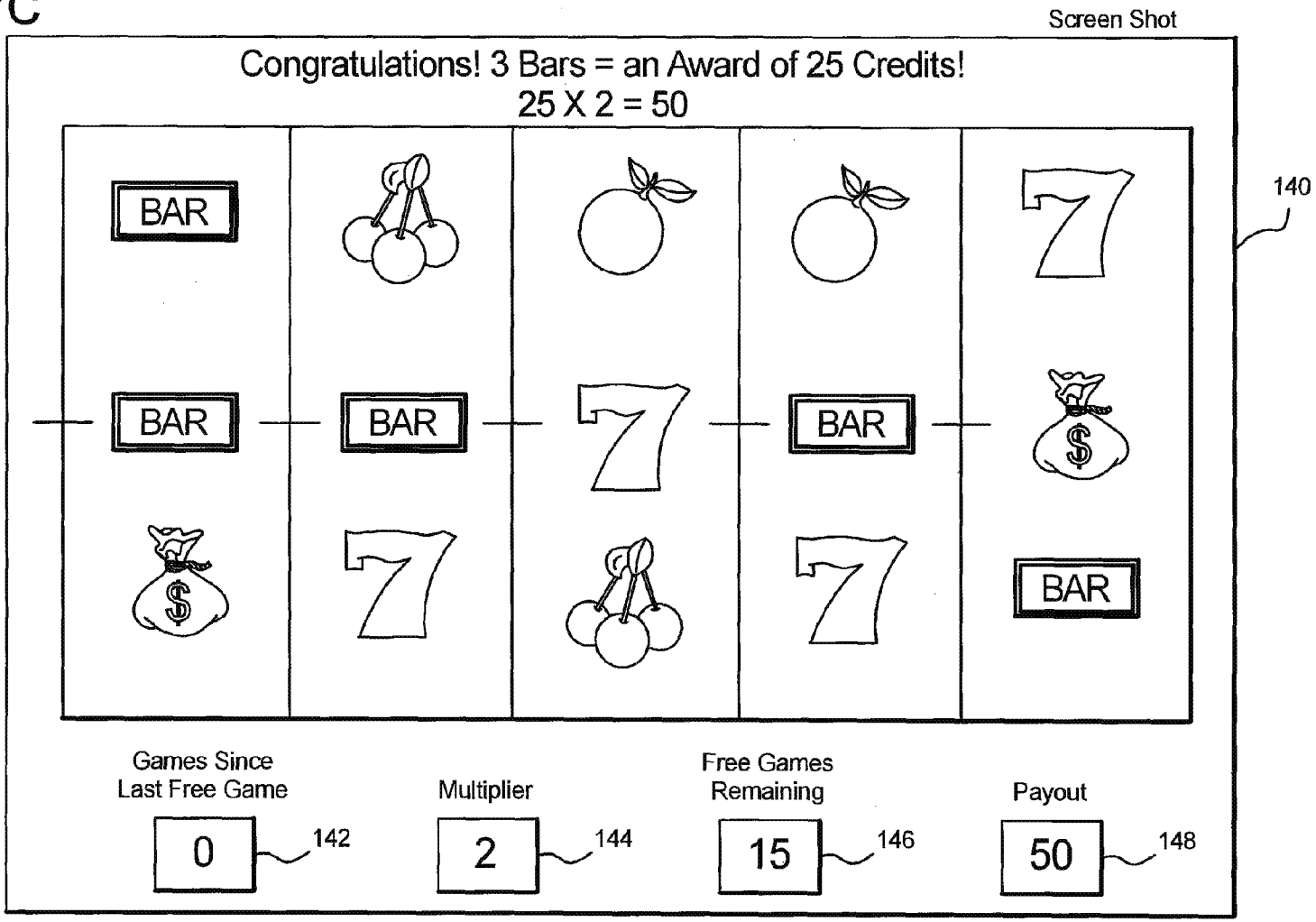

FIGS. 7A, 7B and 7C illustrate screen shots of a gaming machine of one embodiment of the present disclosure. In one embodiment, the first game is a wagering slot game displayed by a display device 140 of a gaming machine. In one embodiment, the triggering event is the symbol combination of five star symbols. The number of plays of free games that the gaming machine provides to the player is based on the number of consecutively played wagering games from an initial start time. The initial start time is either: (i) when the player started playing the gaming machine if the player has not won any free games; or (ii) the time of a first wagering game after playing free games.

As in FIG. 7A, in this example, the gaming machine display device 140 includes a plurality of game displays. The gaming machine display device includes a display of the count of the number of consecutively played wagering games 142. That is, the number of wagering games played since an initial start time of either: (i) when the player started playing the gaming machine if the player has not won any free games; or (ii) the time of a first wagering game after playing free games. The gaming machine display device 140 includes a multiplier display 144. The gaming machine display device includes a number of free spins/games remaining display 146. The gaming machine display device includes a payout display 148 that displays the payout for each game.

As illustrated in FIG. 7A, the player currently has currently played twelve consecutive wagering games as indicated by display 142, does not have a multiplier as indicated by display 144 or free spins remaining as indicated by display 146. In this slot game, the gaming device generates the symbol combination cherry-cherry-orange-money-seven. The gaming machine informs the player that they win ten credits and displays ten credits in the payout display 148.

As illustrated in FIG. 7B, the player has now played seventy one consecutive wagering games as indicated by display 142, does not have a multiplier as indicated by display 144 or any free spins remaining as indicated by display 146. In this slot game, the gaming device generates the combination star-star-star-star-star. This combination provides the player a triggering event. The gaming machine determines a number of plays of free games and a multiplier to provide to the player based on the number of consecutive wagering games played.

As illustrated in FIG. 7B, the gaming machine informs the player that the player wins sixteen free games and a multiplier of two.

As illustrated in FIG. 7C, the player plays one of the player's free games. The consecutive game display 142 displays a 0 because the player is currently playing free games. The multiplier display 144 displays a 2 and the free games remaining display 146 displays a 15. As illustrated in FIG. 7C, the gaming device generates a combination of bar-bar-seven-bar-money bag in the first free game. The gaming machine provides an award of 25 credits for three bars. Since the player won the multiplier of 2, the award of 25 is multiplied by 2 and the player is provided an award of 50 credits for that free play of the game. The gaming machine enables the player to play all of the free games with a multiplier of two and provides the player any awards.

It should be appreciated that the number of plays of the second type of game provided to the player may increase in any suitable manner. In one embodiment, each possible number of consecutively played first types of games is included in an interval and each interval is associated with a range of numbers of the second type of game. That is, each number of plays of the second type of games is associated with more than one number of consecutively played first type of games. In one embodiment, the gaming machine, system or method randomly associates one of the numbers of the second type of game with the number of consecutively played first type of game upon a triggering event. In one embodiment, the gaming machine, system or method randomly associates an advantage of the second type of game with the number of consecutively played first type of game upon a triggering event. In another embodiment, the gaming machine, system or method associates a predetermined one of the numbers of the second type of game with the number of consecutively played first type of game upon a triggering event. In one embodiment, the gaming machine, system or method associates a predetermined advantage of the second type of game with the number of consecutively played first type of game upon a triggering event.

As illustrated in FIG. 8, in one embodiment, the gaming machine, system or method associates a range of numbers of a second type of game and a range of advantages for a second type of game with an interval of numbers of consecutively played first type of game. In the illustrated example, the first type of game is a wagering game and the second type of game is a free game. The advantage is a multiplier provided for the second type of game. In one embodiment, as the number of consecutively played wagering games increases, the numbers in the range of free games provided to the player increases. Additionally, in one embodiment, as the number of consecutively played wagering games increases, the range of the value of the multipliers applied to the free games increase.

For example, as illustrated in FIG. 8, if a player plays from 1 to 10 consecutive wagering games and then achieves a triggering event, the gaming machine provides the player with a number free spins or free games in the range of 5 to 10 free spins and a multiplier in the range of 1 to 3 for each free game. If a player plays from 31 to 40 consecutive wagering games and then achieves a triggering event, the gaming machine provides the player with a number of free spins or free games in the range of 9 to 12 and a multiplier in the range of 2 to 4 for each of the free games. If a player plays from 61 to 80 consecutive wagering games and then achieves a triggering event, the gaming machine provides the player with a number of free spins in the range of 12 to 15 and a multiplier in the range of 3 to 5 for the free games.

The gaming machine, system or method may determine the number of second type of games to provide the player from the associated range in any suitable manner. In one embodiment, upon the occurrence of a triggering event, the gaming machine, system or method randomly associates one of the numbers in the range of the second type of game with the number of consecutively played first type of game upon a triggering event. For example, as illustrated in FIG. 8, if a player plays from 1 to 10 consecutive wagering games and then achieves a triggering event, the gaming machine provides the player with a number free spins or free games in the range of 5 to 10 free spins. The gaming machine, system or method randomly determines whether to provide the player 5, 6, 7, 8, 9 or 10 free spins. Likewise, in one embodiment, the gaming machine, system or method randomly associates an advantage of the second type of game with the number of consecutively played first type of game upon a triggering event. For example, as illustrated in FIG. 8, if a player plays from 1 to 10 consecutive wagering games and then achieves a triggering event, the gaming machine provides the player with a multiplier in the range of 1 to 3 for each free game. The gaming machine, system or method randomly determines whether to provide the player a multiplier of 1, 2 or 3 for the free games. In one embodiment, the multiplier is the same for each of the free games provided. In another embodiment, the gaming machine randomly determines a multiplier in the range of multipliers for each of the free games. For example, a first free game may have a multiplier of 2 and a second free game may have a multiple of 1.

In another embodiment, the gaming machine, system or method associates a predetermined one of the numbers of the second type of game with the number of consecutively played first type of game upon a triggering event. For example, as illustrated in FIG. 8, if a player plays from 1 to 10 consecutive wagering games and then achieves a triggering event, the gaming machine provides the player with a predetermined number free spins or free games in the range of 5 to 10 free spins and a multiplier in the range of 1 to 3 for each free game.

In another embodiment, the determination of which number of free spins in the range of free spins to provide the player is determined based on a suitable factor or aspect of game play. The determined number of the second game in the range of second games to provide to the player may be based on, but is not limited to: (a) a single wager amount, (b) a number of wager amounts, (c) a player tracking statistic, such as a player ranking, (d) the length of time the player has been playing at the gaming machine, (e) the wager denomination, (f) the advantage provided to the player, (g) a side wager or (h) any combination thereof or any additional suitable factor.

In one embodiment, the gaming machine, system or method associates a predetermined advantage of the second type of game with the number of consecutively played first type of game upon a triggering event. For example, as illustrated in FIG. 8, if a player plays from 1 to 10 consecutive wagering games and then achieves a triggering event, the gaming machine provides the player with a predetermined multiplier in the range of 1 to 3 for each free game. It should be that the determination of which number of multiplier in the range of multipliers to provide the player may be determined in any suitable manner or based on any suitable factor. The determined advantage in the range of advantages to provide to the player may be based on, but is not limited to: (a) a single wager amount, (b) a number of wager amounts, (c) a player tracking statistic, such as a player ranking, (d) the length of time the player has been playing at the gaming machine, (e) the wager denomination, (f) the number of second type of games provided to the player, (g) a side wager, or (h) any combination thereof or any additional suitable factor.

In one embodiment, as the number of consecutively played wagering games increases, the possible number of plays of free games increases. In one embodiment, as the number of consecutively played wagering games increases, the average expected amount a player wins increases and the amount a player can ultimately win increases. For example, if in the free games the average expected value provided to a player per game is 95 cents per dollar wagered, the amount on average a player wins increases per free game played. Additionally, when a multiplier is applied to each win, the average amount a player wins per game increases assuming they wager the same amount for each game. Additionally, the player's award volatility increases as the number of consecutively played wagering games increase. That is, the total amount a player has the possibility of winning increases for each interval of consecutively played free games.

In one embodiment, as the number of consecutively played wagering games increases, the range of advantages increases.

In another embodiment, as the number of consecutively played wagering games increases, the possible number of plays of free games does not increase. In one embodiment, as the number of consecutively played wagering games increases, the range of advantages increases.

Figure 9A:
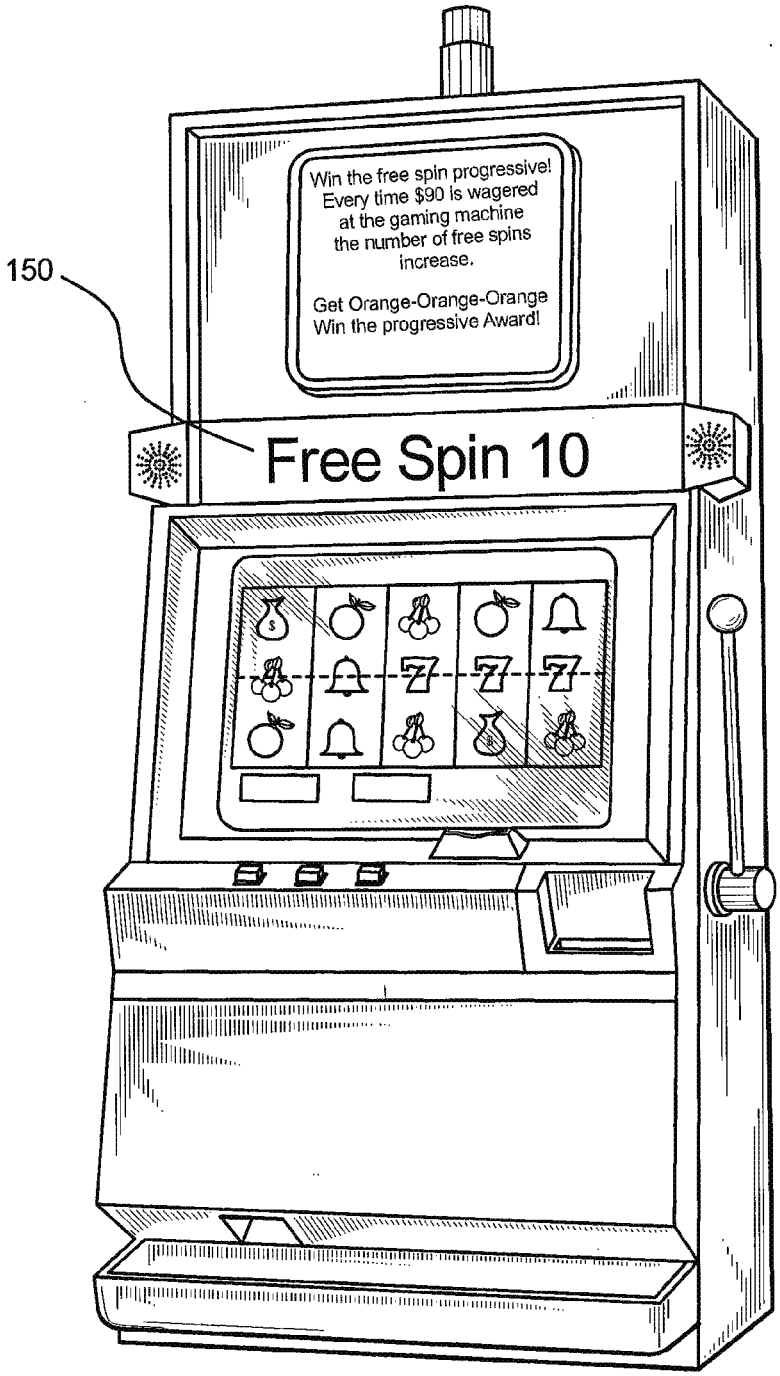
FIGS. 9A, 9B and 9C are perspective views of one embodiment of a gaming device including a free spin progressive award.
Figure 9B:
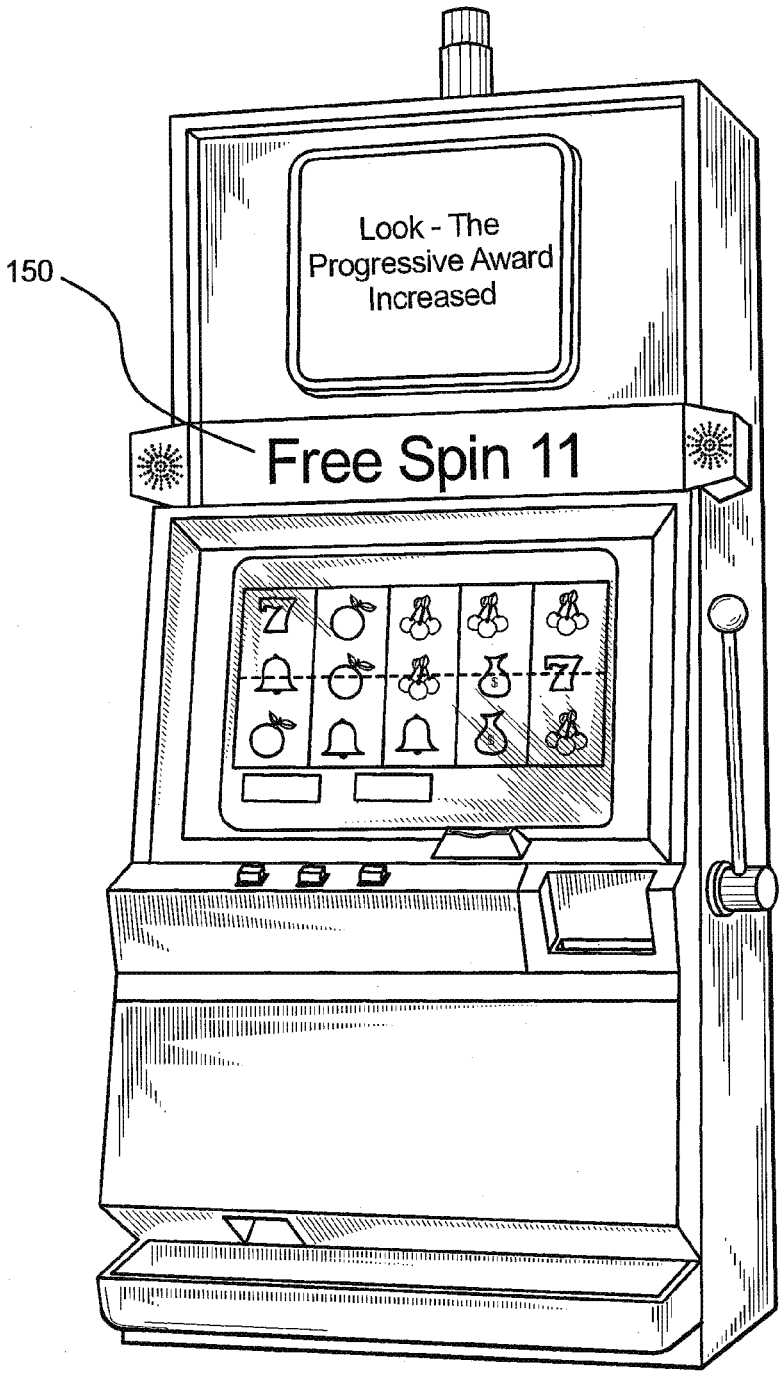
Figure 9C:
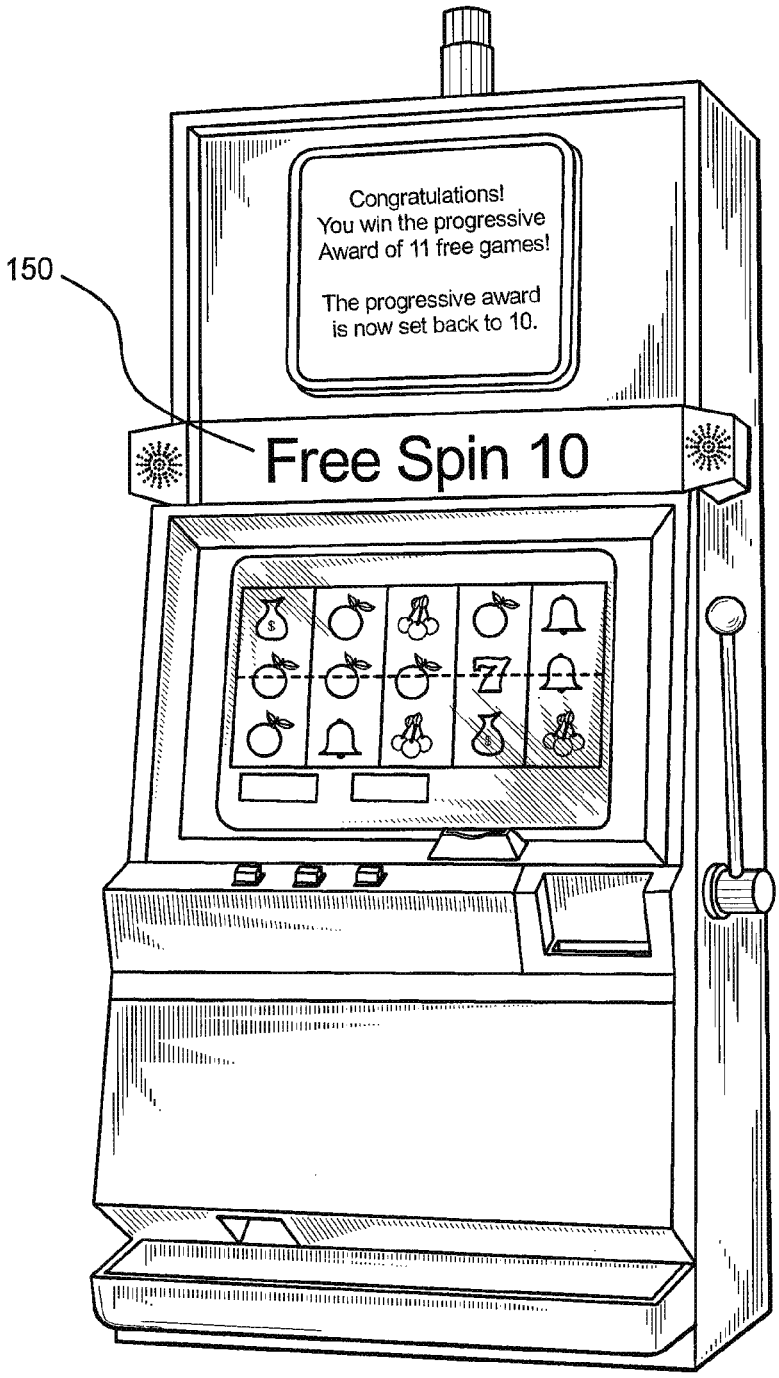

In one embodiment, the gaming machines include at least one progressive or accumulated award. As illustrated in FIGS. 9A, 9B and 9C an incrementing condition increases the progressive award. In one embodiment, the incrementing condition is associated with the first type of game. In one such embodiment, the progressive award is a number or quantity of plays of the second type of game, such as number of plays of free games, free activations or free spin games. In one such embodiment, the progressive award increases based on increments of wagers placed at that gaming machine. For example, each time $180 is wagered at the gaming machine, the gaming machine increments the secondary game amount of the progressive award by one. When a triggering event occurs, the gaming machine provides the player with the number of the second game displayed on the gaming machine.

As illustrated in FIGS. 9A, 9B and 9C, the gaming machine includes a progressive award 150. It should be appreciated that one or more progressive awards may be displayed in any suitable manner. In one embodiment, a portion of each wager placed is the gaming machines funds one or more progressive awards. In one embodiment, the progressive award is a number of free spins and each free spin has an average expected payout, such as $0.90. The progressive award has a base amount that the progressive starts at, such as 10 free spins. Therefore, the average expected payout for the 10 free spins is $9.00 (0.90×10). In one embodiment, a portion of each wager placed at the gaming machines funds one or more progressive awards and therefore the progressive increments based on the amount of the wagers placed since the last progressive award win. That is, the wagers placed at the gaming machine are the incrementing conditions for the progressive award.

As illustrated in FIG. 9A, in one embodiment, the progressive award amount 150 starts at the base amount of 10. In one embodiment, 1% of every wager placed at the gaming machine funds the progressive award. In this example, every time the players wager $90, the progressive award increases by one. The triggering event for the progressive award is a symbol combination of orange-orange-orange.

As illustrated in FIG. 9B, the progressive award increases to 11 after $90 are wagered at the gaming machine. The gaming machine continues to increment the progressive award until a triggering event occurs, such as a designated symbol combination in the primary game. In one embodiment, upon awarding the progressive award, the gaming machine resets the progressive award to the base amount and the process begins again. In one embodiment, any amount that remains proceeds to increase the progressive award when it is reset. For example, a player triggers a progressive award after $180 dollars are wagered, the player will receive a progressive award of 12 free spins (10 base free spins+(180/90)). In this example, the $180 is easily divisible by the $90 total wager needed to fund the cost of a single free spin. For example, a player triggers a progressive award after $225 dollars are wagered, the player will receive a progressive award of 12 free spins. The player receives 10 base free spins and 2 funded free spins. However, there is an amount remaining in the free spin account. That is, the amount remaining is $0.45 in the free spin account which is determined by 225 (the amount wagered)−180 (the cost of the two awarded free spins)*0.01. In this example, the $225 is not easily divisible by the $90 total wager needed to fund the cost of a single free spin. Therefore, the extra money in the fund is held over until after the progressive award resets. The progressive award fund then begins at $0.45. That is, in one embodiment, the gaming machine resets the progressive award and keeps any remaining funds left over from the progressive award payout in the progressive award fund. It should be appreciated that the cost of the free spins is the average estimated cost and each free spin may generate any suitable award. In one embodiment, the progressive award win amounts are a predetermined number. For example, each time a player wins in the second type of game, the player receives a certain amount of credits. In another embodiment, the progressive award win amounts are variable. That is, each time a player wins in the second type of game, the gaming device and/or system determines an award to provide the player.

In one embodiment, if the player retriggers the progressive award, that is, wins the progressive award based off of the games provided by the progressive award, the gaming machine may determine any suitable award to provide the player. In one embodiment, when the player re-triggers the progressive award, the player receives the same progressive award that they won previously. In another embodiment, when a player re-triggers the progressive award, the player wins the base amount of the progressive award.

In an alternative embodiment, before the progressive award increases, the players' initial wagers fund the initial amount of the progressive award. For example, in the above example, when $900 is wagered at the gaming machine, the progressive fund covers the average expected payout of the 10 free spins, which is $9 (10×0.90). When the progressive fund covers the average expected payout of the base amount, in this example $9, the progressive award increments based on subsequent wagers.

As illustrated in FIG. 9C, the gaming machine generates the symbol combination of orange-orange-orange and provides the player with the progressive award. The gaming machine resets the progressive award to 10 and provides the player the 11 free games.

It should be appreciated that the progressive award may be funded in any suitable manner. In one embodiment, a percentage of each credit wagered is allocated to the progressive award or funds the progressive award. For example, if each free spin is on average worth 23 credits and 2.5% of each credit wagered is allocated to fund the progressive award, the progressive award increases every 920 credits wagered. That is, 2.5% of 920 credits is 23 credits, the average payback of a free spin.

In one embodiment, the progressive award also includes an advantage for the second type of games won by the progressive award, such as a multiplier. In one embodiment, the advantage increases in a similar manner to the number of secondary games increasing. It should be appreciated that the number of secondary games and the advantage may increase by the same or different relative increments. In one embodiment, the base award of the progressive includes a base advantage, such as a multiplier of 2, the advantage is incremented based on a suitable incrementing condition, such as the placement of wagers at the gaming machine. When the player triggers the progressive award, the gaming machine provides the player with the number of secondary games and the advantage. The gaming device then resets the progressive award to the base amount.

In one embodiment, the advantage or characteristic increases as the number of plays of the second type of game increase. In another embodiment, the advantage remains the same as the number of plays of the second type of game increase. In another embodiment, there is not an advantage.

In one embodiment, the number of plays of the second type of game and the advantage associated with the second type of game have different incrementing conditions. For example, the number of plays of the second type of games provided to the player is based on the number of consecutive wagering games played and the advantage is based on the wagers placed at that gaming machine. It should be appreciated that the progressive award may be based on any suitable number of implementers.

In one embodiment, a progressive award win is triggered based on one or more game play events, such as a symbol-driven trigger. In other embodiments, the progressive award triggering event or qualifying condition may be by exceeding a certain amount of game play, such as number of games, number of credits, or amount of time. In other embodiments, in another embodiment, the progressive award triggering event or qualifying condition may be reaching a specified number of points earned during game play. In another embodiment, a gaming device is randomly or apparently randomly selected to provide a player of that gaming device one or more progressive awards or a gaming device randomly determines to provide a player the progressive award. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

More specifically, in one embodiment, the triggering of the progressive award occurs based on at least one accumulated value pool incrementing to a hit value. In one such embodiment, the gaming system includes one or more accumulated value progressive awards or Nth coin progressive awards. Such progressive awards or accumulated awards are driven by an amount of wagers placed or a suitable coin-in amount. In one such embodiment, each progressive award is associated with a range of values, wherein each progressive award will be provided to a player of a gaming device in the gaming system when the progressive award increments to a progressive award hit value within the range of values associated with that progressive award. That is, when a progressive award increases to a determined progressive award hit value, the triggering event occurs. In different embodiments, the progressive award hit value at which a progressive award causes a triggering of the progressive award is predetermined, randomly determined, determined based on the wagers placed in the gaming system, determined based on the status of one or more players (such as determined through a player tracking system), determined based on time, or determined based on any other suitable method. In this embodiment, after the accumulated value triggers the progressive award, the progressive award is reset to a default value and starts incrementing from the default progressive award level.

In operation of one such embodiment, the central server which hosts one of these progressive awards or gaming machine: (1) determines a minimum amount and a maximum amount for the progressive award or prize pool, (2) provides that the progressive award or prize pool starts at the minimum, (3) determines a progressive award hit value between the minimum amount and the maximum amount, (4) increments the progressive award or prize pool with a configured percent of coin-in, and (5) causes a triggering of the progressive award when the progressive award or prize pool equals the determined progressive award hit value. In this embodiment, the progressive award hit value is determined at random to maintain fairness for the players at the gaming device or the gaming devices of the gaming system, wherein the players are not aware of any determined progressive award hit value.

In different embodiments, the range of values associated with a progressive award is predetermined, randomly determined, determined based on the wagers or credits placed in the gaming system, the number of consecutive first games played, determined based on the status of one or more players (such as determined through a player tracking system), determined based on time, or determined based on any other suitable method. In one embodiment, a plurality of progressive awards are associated with different value ranges. In another embodiment, each of a plurality of progressive awards are associated with a different value range. In another embodiment, a plurality of progressive awards are associated with the same value range. In another embodiment, the value range associated with a progressive award a player plays for is based on a player's status (via a player tracking system). For example, a bronze level player may play for a progressive award associated with a value range of $10 to $100, a silver player may play for a progressive award associated with a value range of $200 to $500 and a gold player may play for a progressive award associated with a value range of $1000 to $5000.

In another embodiment, the triggering of the progressive award is based on time. In this embodiment, a time is set for when a triggering event will occur. In one embodiment, such a set time is based on historic data. For example, if previous progressive triggering events have occurred after approximately sixty-seven hours, a triggering event may be set to trigger sixty-seven hours from the conclusion of the previous triggering event. In one embodiment, a suitable algorithm is implemented to determine the player who wagered at or closest to this time with tie-breaking based on any number of factors (e.g., player tracking history, amount of or recent wagers placed). In this embodiment, the gaming device which the algorithm determined wagered closest to when the previous progressive triggering event triggered is designated the triggering gaming device. In another embodiment, one of the gaming devices which placed a wager during a designated time period is randomly selected and designated as the triggering gaming device.

In another such embodiment, the progressive triggering event is based on a predefined variable reaching a defined parameter threshold. For example, the progressive triggering event is triggered when the 500th different player has played a gaming machine associated with one of the progressive awards (ascertained from a player tracking system). In different embodiments, the predefined parameter thresholds include a length of time, a length of time after a certain dollar amount is hit, a wager level threshold for a specific machine (which gaming device is the first to contribute $250,000), a number of gaming machines active, or any other parameter that would define a threshold for the progressive.

In another embodiment, the progressive triggering event occurs after a random number of plays in which a progressive award is not provided to a player. In another embodiment, the progressive triggering event is based upon gaming system operator defined player eligibility parameters stored on a player tracking system (such as via a player tracking card or other suitable manner). In another embodiment, the progressive triggering event is based upon gaming system operator defined player eligibility parameters stored on a player tracking system (such as via a player tracking card or other suitable manner).

In another such embodiment, the progressive triggering event includes a system determination which is based on a random selection by the central controller or the gaming machine. In this embodiment, the central controller tracks all active gaming machines and the wagers they placed (via an accumulated wager pool). When the accumulated wager pool at least exceeds a predefined threshold, the central controller randomly determines (at predetermined intervals) if a bonus event will occur. In one embodiment, the player who consistently places a higher wager is more likely to receive cause a bonus event to be triggered than a player who consistently places a minimum wager.

In another such embodiment, the central controller determines, in cooperation with the gaming device, when to trigger the progressive award by utilizing one or more random number generators. In one embodiment, the central controller determines when to trigger a progressive award by determining if any numbers allotted to a gaming device match a randomly selected number. In one such embodiment, upon or prior to each play of each gaming machine, a random number is selected from a range of numbers and during each first game, the gaming machine allocates the first N numbers in the range, where N is the number of credits bet by the player in that first game. At the end of the first game, the randomly selected number is compared with the numbers allocated to the player and if a match occurs, that particular gaming machine triggers the progressive award. It should be appreciated that any suitable manner of triggering the progressive award may be implemented with the gaming system disclosed herein.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

It should be appreciated that a gaming machine or system may enable a player to wager different denominations. For example, a player may wager credits in the amount of $0.25, $0.50, $1 and $5. In one embodiment, the progressive award increases based on a percent of the wager. Therefore, the progressive award increases more quickly when players wager a larger amount. For example, 10% of a wager funds the progressive award and the player wagers four credits. If the player chooses a denomination of $0.25, only $0.10 funds the progressive award. If the player chooses a denomination of $0.50, only $0.20 funds the progressive award. However, if the player chooses a denomination of $5, $2 funds the progressive award, causing it to increase faster. Therefore, if the average expected payback of a free spin is $0.90, every time a player wagers $18, the progressive award increments. The progressive award will increment faster as a larger amount is contributed to the progressive fund. In one embodiment, the gaming machine pays out the awards for the free spins in a predetermined denomination. That is, regardless of the denomination that the player chooses to play, the gaming machine pays the player in a predetermined denomination for any wins resulting from any free spins. In an alternative embodiment, the gaming machine pays back the player in a denomination determined based on the player's wagers.

It should be appreciated that the progressive award may be incremented based on any suitable incrementing condition or suitable factor including but not limited to (a) wagers, (b) side wagers, (c) total number of wagers, (d) number of total games played, (e) wins on the gaming machine (e.g., the number of payline wins, ways won or hands in a poker game won), (f) the amount won at the gaming machine, (g) a player playing with a certain player statistic, such as a player ranking, or (h) any suitable combination of factors.

It should also be appreciated that the progressive may be linked or funded by a single gaming machine or a plurality of gaming machines. That is, a single gaming machine may fund and award a progressive award. In another embodiment, multiple gaming machines, such as a bank of gaming machines fund a progressive award. It should be appreciated that any suitable number of gaming machines may fund a progressive award.

In another embodiment, the gaming machine or gaming system includes a plurality of progressive awards. The progressive awards start at different levels or have different base levels such as 10 free games, 20 free games and 50 free games and increment or increase until provided to a player. The progressive awards accumulate based on a small percentage (such as 0.10%) of coin-in or wagered amounts in a conventional manner. In one embodiment, the percentage that goes to each progressive award is equal (such as 0.10% to each of four progressive awards). In other embodiments, two or more of the progressive awards may be funded by different percentages. In these embodiments, the gaming machine continues to increase the progressive levels until a progressive award is provided to a player, upon the occurrence of a progressive triggering event, at which point another progressive award starts being incremented from the appropriate progressive award level.

In one embodiment, a plurality of gaming machines at one or more gaming sites are networked to the central server in a progressive configuration, wherein a portion of each wager placed is allocated to one or more progressive awards. In one embodiment, the progressive awards are associated with the system gaming machines which each contribute portions of the progressive awards.

In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state. In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

In one embodiment, the central server or other central controller determines when a progressive win is triggered. In this embodiment, a central controller and an individual gaming machine work in conjunction with each other to determine when a progressive win is triggered, for example through an individual gaming machine meeting a predetermined requirement established by the central controller. In another embodiment, an individual gaming machine may trigger a progressive win.

In another embodiment, the server or central controller maintains a separate progressive award for each player which is tracked via a player tracking system (implemented through the use of a playing tracking card or any other suitable manner). That is, the progressive award is incremented based on events associated with the individual players instead of the events on an individual gaming machine. In this embodiment, the gaming system is configured to track each player's wagers and base any supplemental awards, on the player's progressive award. In this embodiment, if a player leaves the gaming machine of the gaming system, that player's incrementing conditions (e.g., wagered amounts) are saved for the player for later use at another gaming machine. In one embodiment, if the player leaves a gaming machine of the gaming system, the player's incrementing conditions (e.g., wagered amounts) are retained through the playing tracking system or the player tracking card until a designated time or triggering event. In another embodiment, if the player leaves a gaming machine of the gaming system without transferring the wagers allocated to their personal individual accounts using the player tracking system (e.g., the player is not registered in the player tracking system or the player does not have a playing tracking card), the gaming system sets certain criteria which must be fulfilled to reset their individual progressive awards.

In different embodiments, the number of supplemental award bonus event threshold amounts selected for each progressive award is predetermined, randomly determined, determined based on the wagers placed in the gaming system, determined based on the status of one or more players (such as determined through a player tracking system), determined based on time, determined based on the level of each progressive award, or determined based on any other suitable method.

In one embodiment, instead of increasing the number of plays of the second type of game provided based on the consecutive number of the first type of game played, the number of plays of the second type of game remains the same but an aspect or characteristic of the second game is changed based on the consecutive number of the first type of game played. For example, upon a triggering event, the player is awarded a second number of games. However, the number of bonus symbols in the second type of game is based on the consecutive number of first type of game played. For example, if the player plays 1 to 15 consecutive wagering games, the gaming machine provides 3 bonus symbols in each of five free games. If the player plays 16 to 25 consecutive wagering games, the gaming machine provides 5 bonus symbols in each of five free games. It should be appreciated that any suitable aspect of the second type of game may be based on the number of consecutive first type of game played. In one embodiment, the second game includes retrigger symbols, in one such embodiment, the number of retrigger symbols is based on the number of consecutively played first type of game. By adding more bonus symbols, progressive symbols or retrigger symbols in the second type of game, the odds that a player will win a bonus award or game, a progressive award or re-trigger the number of free games increases. In another embodiment, the average payback percentages for the second type of game increase based on the consecutive number of the first type of game played. In another embodiment, the average payback percentages for the second type of game are based on the consecutive number of the first type of game played. In one embodiment, only the second type of game includes special symbols such as one or more bonus symbols and one or more progressive symbols.

In one embodiment, a gaming machine includes a plurality of different types of the second type of game. For example, the second types of games may include different graphics, be different kinds of games, such as selection games and slot games, or they may be the same type of game but have different features, such as different numbers of special symbols or the ability to trigger an additional bonus game. Which bonus game is provided to the player is based on any suitable factor, such as how many games have been played since the last triggering event or how many credits have been wagered since the last triggering event. When a triggering event occurs with a certain number of games played or a certain amount wagered, the gaming machine enables the player to play the first bonus game. When a triggering event occurs with a second certain number of games played or a certain amount wagered, the gaming machine enables the player to play the second bonus game.

Figure 10A:
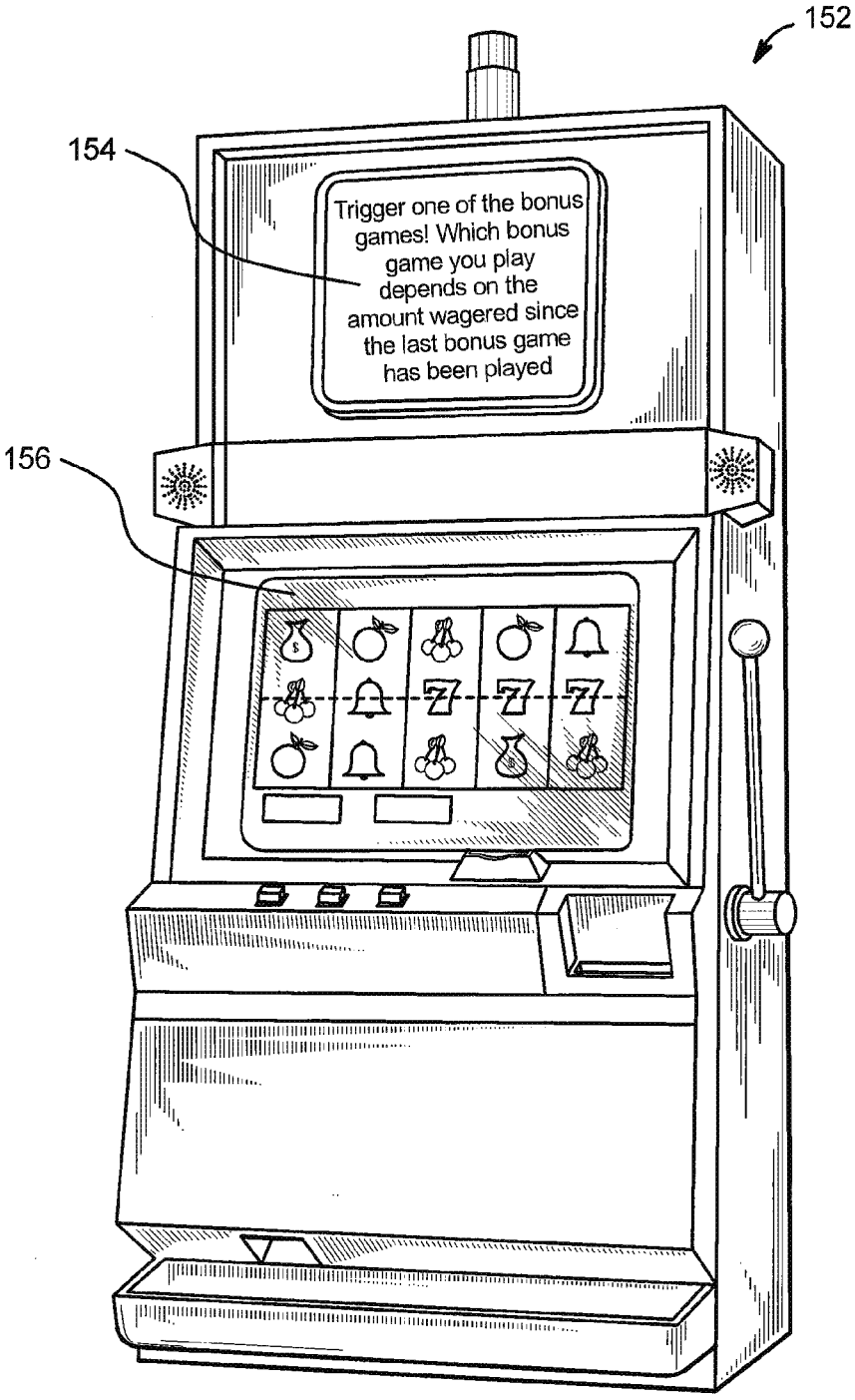
FIGS. 10A, 10B and 10C are perspective views of one embodiment of a gaming device including a plurality of different types of bonus games.
Figure 10B:
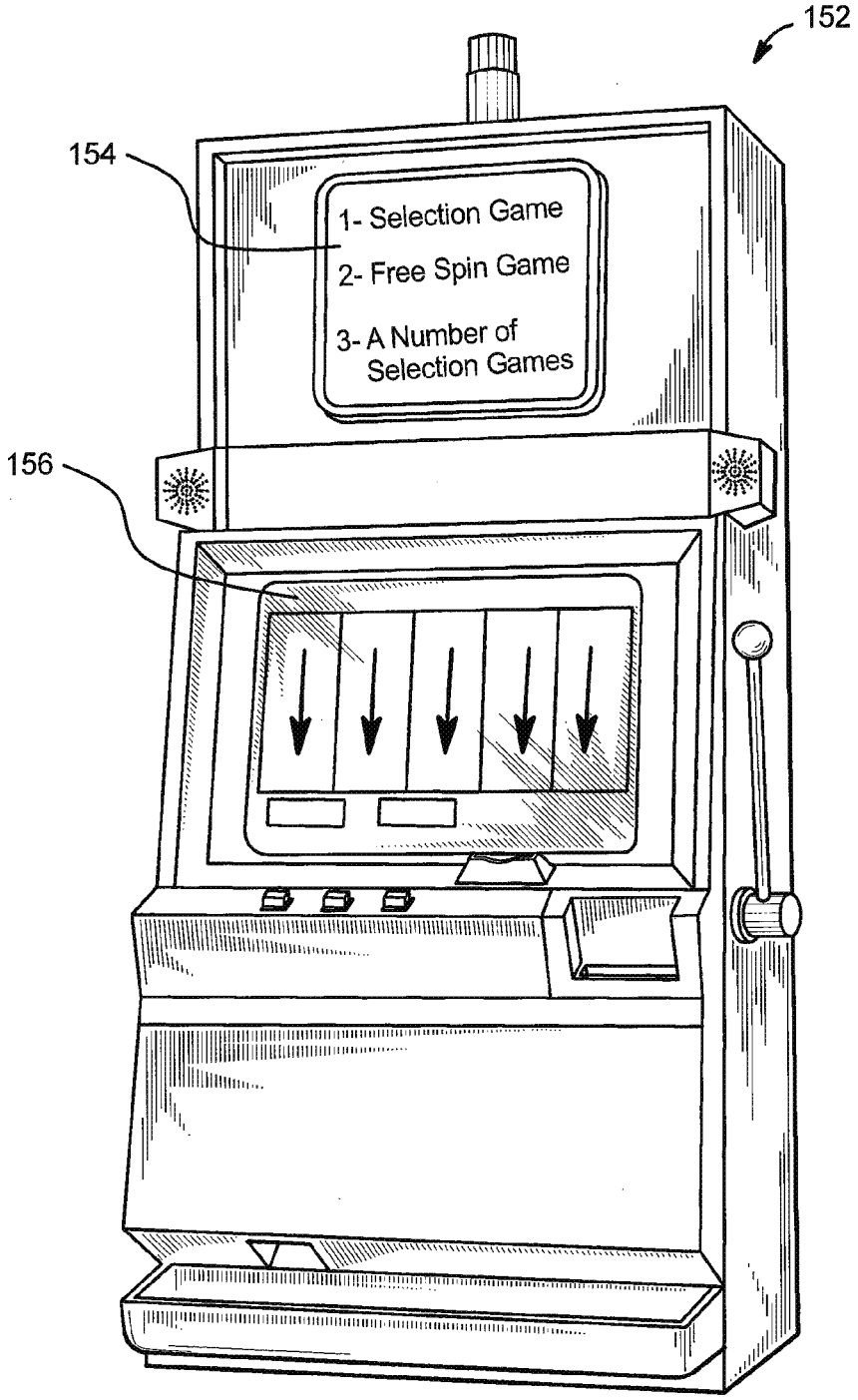
Figure 10C:
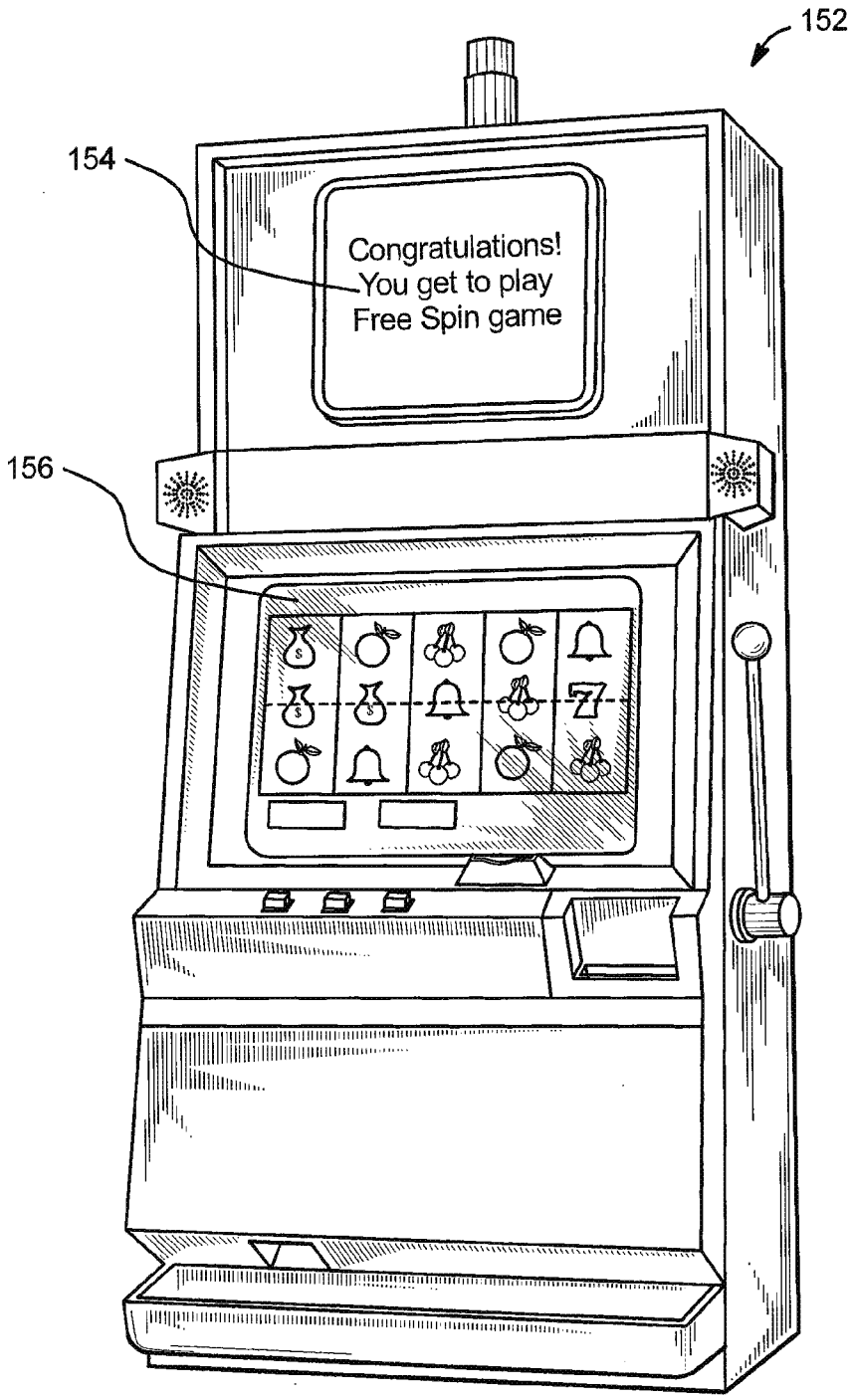

As illustrated in FIGS. 10A, 10B and 10C, in one embodiment, a gaming machine 152 includes a plurality of different bonus games. The gaming machine determines which bonus game to provide to the player based on a suitable factor. In the illustrated embodiment, the gaming machine determines which bonus game to provide to the player based on how many credits have been wagered since the last bonus game occurrence.

As illustrated in FIG. 10B, the gaming machine includes a plurality of bonus games: a selection game, a free spin game and a plurality of selection games (combination free spin and selection game). Upon a triggering event, if 0 to 100 credits have been wagered on the gaming machine since the last bonus game occurrence, the gaming machine enables the player to play the first bonus game—the selection game. Upon a triggering event, if 101 to 150 credits have been wagered on the gaming machine since the last bonus game occurrence, the gaming machine enables the player to play the second bonus game—the free spin game. Upon a triggering event, if 151 to 250 credits have been wagered on the gaming machine since the last bonus game occurrence, the gaming machine enables the player to play the third bonus game—the plurality of free spin games. The triggering event for the bonus games may be any suitable triggering event. In the illustrated embodiment, the triggering event is the combination of two moneybag symbols on an active payline.

As illustrated in FIG. 10B, the player plays the game and the gaming machine informs the player of the different bonus games.

As illustrated in FIG. 10C, the gaming machine generates the combination of two money bags on an active payline. The gaming machine determines how many credits have been wagered since the occurrence of the last bonus game trigger or bonus game. In the illustrated embodiment, there have been 137 credits wagered since the last bonus game occurrence. Therefore, the gaming machine informs the player that they will play the free spin game.

It should be appreciated that the second games may be different in any suitable manner. The second games may have different (a) symbols, (b) graphics, (c) average payback percentages, (d) paytables, (e) numbers of free spins, (f) numbers of special symbols, (g) numbers of paylines, or (h) any other suitable characteristic.

In one embodiment, the player is required to wager a certain amount, such as the maximum wager or to wager a side wager to be eligible to win the second types of games. In this embodiment, a player must place or wager a side bet to be eligible to win a number of the types of games associated with the side bet. In one embodiment, the number of plays of the second type of games awarded increase as the amount of the side wagers increase. In one embodiment, the player must place the maximum bet and the side bet to be eligible to win award. In another embodiment, if the player places or wagers the required side bet, the player may wager at any credit amount during the primary game (i.e., the player need not place the maximum bet and the side bet to be eligible to win one of the award). In one such embodiment, the greater the player's wager (in addition to the placed side bet), the greater the odds or probability that the player will win one of the award.

It should be appreciated that the gaming machine may determine which bonus to provide the player based on any suitable factor including but not limited to coin-in, games played, a player tracking statistic (such as player level), or any other suitable factor.

It should be appreciated that the gaming machine may provide the player any suitable number and type of bonus games.

It should be appreciated that though some examples illustrate the first game as a wagering game and the second game as a free game, the first and second games may be any suitable type of game. In one embodiment, the first game is a base game and the second game is bonus game. In one embodiment, the gaming machines awards players a number of bonus games based on a number of consecutively played wagering games that did not achieve a bonus. That is, the gaming machine counts the number of games played in a row for which the player does not receive a bonus and provides the player a number of bonus games based on this counted number of games. In one such embodiment, it does not matter if the games are free games or wagering games. That is, whether or not the game is a wagering game or a free game, the gaming machine only counts either: (i) the number of games since the player began the session if the player has not achieved a bonus game; or (ii) the number of games since the player last played a bonus game. This determined number determines the number of bonus games provided to a player. In another embodiment, the first game is an individual game and the second game is a group game.

Additionally, the number of plays of the second type of game provided to a player may be based on any aspect of game play and may relate to any suitable award. In one embodiment, instead of the interval or number of the first type of game played determining the number of plays of the second type of game to provide to the player, the number of plays of the second type of game provided to the player is based on another suitable factor. In one such embodiment, the amount of time a player plays at a gaming machine determines the number of plays of the second type of game provided to the player. In another embodiment, the player is not eligible to win a number of plays the second type of game until another condition is satisfied, such as wagering the maximum amount of the first game or being of a certain player rank in a player tracking system.

In one embodiment, instead of awarding a second number of games based on events on a single gaming machine, a player has an account. Upon a triggering event, the player is awarded a number of a second type of game based on information specific to the player. More specifically, in one embodiment, a gaming system includes a player tracking system that monitors and stores the player's gaming activity. At the start of a gaming session, a player logs into a gaming machine to begin a play session. The player tracking session stores information, such as the amount of wagers and the number of games since a last bonus or free game. Upon a triggering event or a triggering event, the gaming machine or system determines a number of plays of the second type of game to provide the player based on the specific information stored in the player tracking system.

In one embodiment, if a player retriggers the second type of game from a second type of game, the gaming machine provides the player with the same number of plays of the second type of game and the same advantage. In one embodiment, if a gaming machine generates a triggering event directly after playing the second type of game, the gaming machine provides the player the same number of second type of game and the same advantage as in the previous series of the second type of game. That is, if a player wins a designated number of plays of the second type of game and a designated advantage and then on the first, first type of game triggers more of the second type of game or triggers a second type of game from the second type of game, in one embodiment, the player wins the designated number of second type of game and the designated multiplier again. For example, if a gaming machine provides a player eight free games and a multiplier of two, in one embodiment, if a gaming machine generates another triggering event either: (a) during one of the free games; or (b) on the first wagering game after playing the free games, the gaming machine provides the player eight more free games with a multiplier of 2 for each of the free games. In another embodiment, if a player obtains another triggering event while playing a second type of game or directly thereafter, the gaming machine provides the player with a fixed amount. In one embodiment, if a player obtains another triggering event while playing a second type of game or directly thereafter, the gaming machine provides the player with a fixed advantage. For example, if a gaming machine provides a player eight free games and a multiplier of two, in one embodiment, if a gaming machine generates another triggering event either: (a) during one of the free games; or (b) on the first wagering game after playing the free games, the gaming machine provides the player a fixed number of games, such as 10 more free games with a fixed advantage, such as a multiplier of 3 for each of the free games. Additionally, the gaming machine may determine the number of plays of the second type of games to provide a player upon a retrigger based on any suitable factor. In one embodiment, the gaming machine determines the number of plays of the second type of game to provide to the player based on a player statistic or how much the player wagered. In another embodiment, the gaming machine alternates between predetermined amounts.

It should be appreciated that the second type of game may be different than the first type of game in any suitable manner, advantage or characteristic. For example, the second type of game may have a different: (i) paytable than the paytable employed in the first type of game; (ii) volatility than the volatility of the first type of game; (iii) average expected payback percentage than the average expected payback percentage of first type of game; (iv) eligibility for a progressive award than the first type of game; (vi) modifier or multiplier than a multiplier employed by the first type of game; (vii) type or kind of the bonus game or free game; (viii) more paylines or more winning combinations than the first type of game; or (ix) any combination of these. Any of the above factors may be determined based on any suitable factor (i.e. a number of consecutively games played without a bonus game) or may be randomly determined.

It should be appreciated that the wager used to calculate the awards for the second games may be configured in any suitable manner. In one embodiment, any awards from the second type of game are based on the wager made on the triggering first type of game. That is, the gaming machine uses the wager placed for the first type of game immediately preceding the awarding of the second type of game to calculate any awards for any played second type of games. For example, if a player wagers $0.50 on a first, first type of game, $1 on a second, first type of game, $0.050 on a third, first type of game and $1 and a fourth, first type of game and the fourth, first type of game triggers the second type of game, (e.g., free games) any awards provided from such played second type of game are based on a $1 wager.

In one embodiment, any awards from the provided second type of game are based on an average of the wagers made on the consecutively played first type of games that determine the number of plays of the second type of game to provide the player. That is, the gaming machine uses the wager placed for the all of the first type of games played in a row to determine any awards for the player in the played second type of game. For example, if a player wagers $0.50 on a first, first type of game, $1 on a second, first type of game, $0.050 on a third, first type of game and $1 and a fourth, first type of game and the fourth, first type of game triggers the second type of game, (e.g., free games) any awards provided from such played second type of game are based on a $0.75 wager ((0.50+1+0.50+1)/4).

In another embodiment, the gaming device enables the player to wager one amount for the first type of game and another amount for the second type of game. In one embodiment, the wager for the triggering first type of game does not affect any of the triggered second type of game. That is, the wager includes a first wager for the first type of game and a second wager for any provided or won second type of games. The second wager then is applied to all of the second type of games triggered upon a play of that gaming machine. For example, the player wagers $3 on the played games and then $5 for any free games. The award from any free game triggered from any of the other games is based on the $5 free game wager.

It should be appreciated that the gaming device of the present invention may include any game operable upon a wager. In one embodiment, all of the games are the same. In another embodiment, one or more of the games are different games. In one embodiment, each of the first type of game is the same game with a same triggering event. In another embodiment, one or more different of the first type of game have different triggering events. In one embodiment, one or more of the first type of game is a different game and is associated with one or more different triggering events.

In an alternative embodiment, all of the games (including all of the first type of games and the second types of games) are associated with a triggering event and thus can trigger a number of plays of the second type of game.

In another embodiment, the gaming machine includes a plurality of different second types of games and enables the player to select second type of game to play. In one embodiment, if a player wins multiple second types of games, the gaming machine enables the player to select a single kind of game for the multiple second types of games and play all of the second types of games as the selected kind of game. In another embodiment, if a player wins multiple second types of games, the gaming machine enables the player to select multiple games for the multiple second types of games. That is, the player selects the kind of game for each second type of game played to the player.

In an alternative embodiment, the gaming machine enables the player to decide whether to accept or reject the provided number of plays of the second type of game. In one embodiment, as the number of consecutively played first type of game increases, the number of plays of the second type of game provided to the player increases. When the player is provided a number of plays of a second type of game, the player can reject that number of plays of the second type of game to try to increase the number of plays of the second type of game provided to the player. For example, the player plays five of a first type of game and the gaming machine provides the player three plays of the second type of game. The player may reject the three plays of the second type of game and continue playing the first type of game. The player then has a chance of winning a greater number of plays of the second types of game based on a larger number of played consecutive first type of games. However, the player risks not winning any more offers to play the second type of game.

Figure 11:
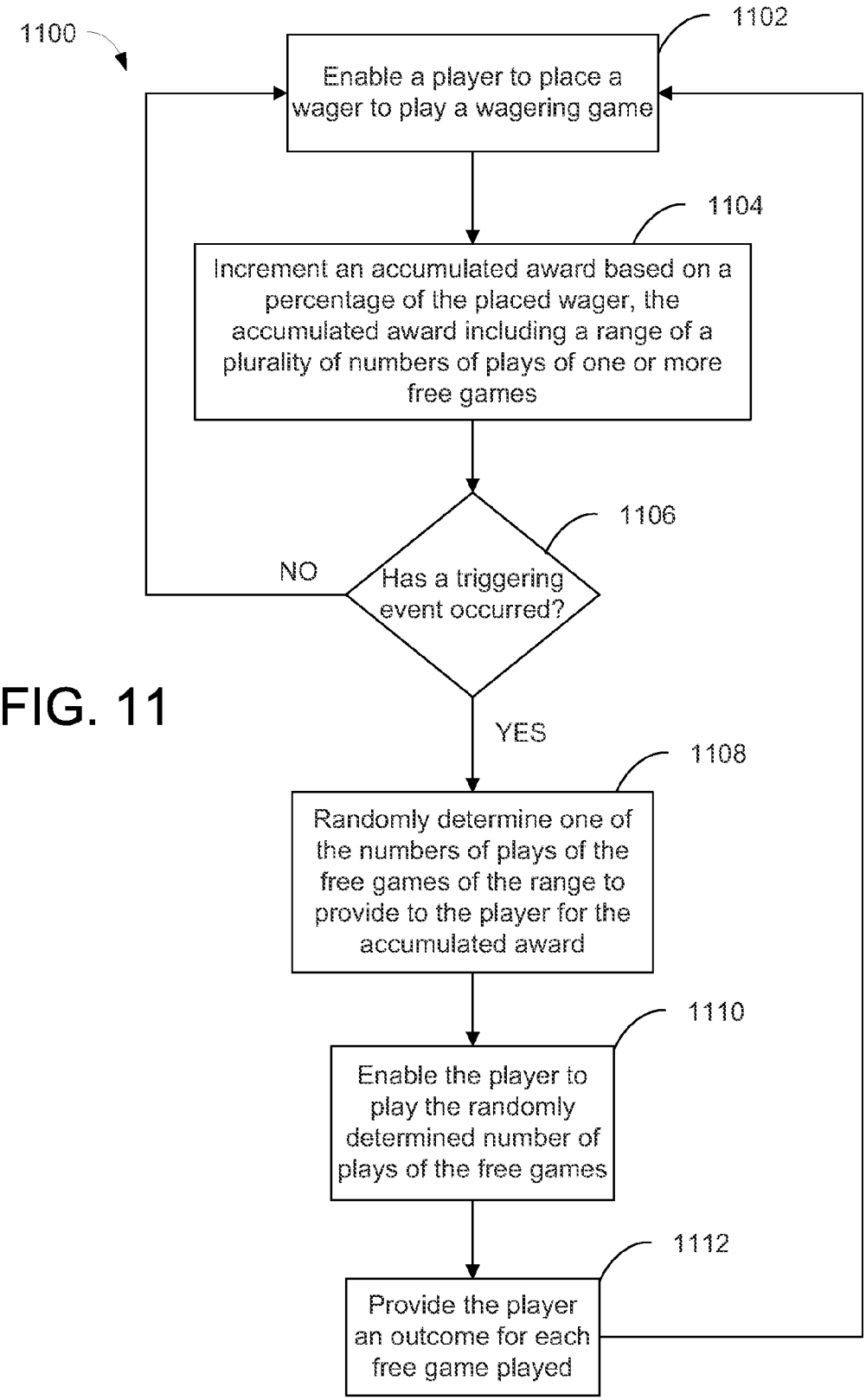
FIG. 11 is a flow chart of the method of one embodiment disclosed herein, illustrating how the gaming system determines the number of free games to provide to a player based on a percentage of wagers made on plays of wagering games.

FIG. 11 illustrates a flow chart of one example embodiment of a method or process 1100 for operating the gaming system of the present disclosure. In operation, the gaming system enables a player to place a wager to play a wagering game, as indicated by block 1102. The gaming system increments an accumulated award based on a percentage of the placed wager, as indicated by block 1104. The accumulated award includes a range of a plurality of numbers of plays of one or more free games. The gaming system determines whether a triggering event occurred, as indicated by diamond 1106. If the gaming system determines that the triggering event did not occur, process 1100 returns to block 1102.

If, on the other hand, the gaming system determines that the triggering event occurred, the gaming system randomly determines one of the numbers of plays of the free games of the range to provide to the player for the accumulated award, as indicated by block 1108. The gaming system enables the player to play the randomly determined number of plays of the free games, as indicated by block 1110. The gaming system provides the player an outcome for each free game played, as indicated by block 1112, and process 1100 returns to block 1102.

While the present disclosure is described in connection with what is presently considered to be the most practical and preferred embodiments, it should be appreciated that the present disclosure is not limited to the disclosed embodiments, and is intended to cover various modifications and equivalent arrangements included within the spirit and scope of the claims. Modifications and variations in the present disclosure may be made without departing from the novel aspects of the invention as defined in the claims, and this application is limited only by the scope of the claims.

The invention claimed is:

1. A gaming device comprising:

at least one processor;

at least one display device;

at least one input device; and at least one memory device storing a plurality of instructions which, when executed by the at least one processor, cause the at least one processor to operate with the at least one display device and the at least one input device to:

(a) enable a player to play one or more wagering games until a triggering event occurs;

(b) increment an accumulated award based on a percentage of wagers made on plays of the wagering games, wherein the accumulated award includes a range of a plurality of numbers of plays of one or more free games;

(c) display the range of the plurality of numbers of plays of the free games of the accumulated award; and (d) upon an occurrence of the triggering event:

(i) randomly determine one of the numbers of plays of the free games of the range to provide to the player for the accumulated award;

(ii) enable the player to play the randomly determined number of plays of the free games; and (iii) provide the player an outcome for each free game played.

2. The gaming device of claim 1, wherein the wagering games and the free games are a same kind of game.

3. The gaming device of claim 1, wherein at least one of the games is selected from the group consisting of: slot, poker, keno, blackjack, craps, bingo, bunco, and checkers.

4. The gaming device of claim 1, wherein the free games include an advantage over the wagering games.

5. The gaming device of claim 4, wherein the advantage is selected from the group consisting of: a modifier, a paytable, a number of paylines, and a number of winning combinations.

6. The gaming device of claim 5, wherein the modifier is a multiplier.

7. The gaming device of claim 1, wherein the triggering event is selected from the group consisting of: a game outcome, a game event, a wager amount, and an accumulated award amount.

8. The gaming device of claim 1, wherein the plurality of instructions, when executed by the at least one processor, cause the at least one processor to operate with the at least one display device to reset the accumulated award to a designated range of a plurality of numbers of plays of the free games upon the occurrence of the triggering event.

9. A gaming system comprising:

a controller; and a plurality of gaming machines, each gaming machine including:

(i) at least one processor;

(ii) at least one display device;

(iii)at least one input device; and (iv) at least one memory device storing a plurality of instructions which, when executed by the at least one processor, cause the at least one processor to operate with the at least one display device and the at least one input device to operate one or more wagering games;

wherein said gaming machines are configured to operate with the controller to:

(a) enable a plurality of players of the gaming machines play the wagering games until a triggering event occurs;

(b) increment an accumulated award based on a percentage of wagers made on plays of the wagering games, wherein the accumulated award includes a range of a plurality of numbers of plays of one or more free games;

(c) display the range of the plurality of numbers of plays of the free games of the accumulated award; and (d) upon an occurrence of the triggering event:

(i) randomly determine one of the numbers of plays of the free games of the range to provide to one of the players of one of the gaming machines for the accumulated award;

(ii) enable the player to play the randomly determined number of plays of the free games; and (iii) provide the player an outcome for each free game played.

10. The gaming system of claim 9, wherein the wagering games and the free games are a same kind of game.

11. The gaming system of claim 9, wherein at least one of the games is selected from the group consisting of: slot, poker, keno, blackjack, craps, bingo, bunco, and checkers.

12. The gaming system of claim 9, wherein the free games include an advantage over the wagering games.

13. The gaming system of claim 12, wherein the advantage is selected from the group consisting of: a modifier, a paytable, a number of paylines, and a number of winning combinations.

14. The gaming system of claim 13, wherein the modifier is a multiplier.

15. The gaming system of claim 9, wherein the triggering event is selected from the group consisting of: a game outcome, a game event, a wager amount, and an accumulated award amount.

16. The gaming system of claim 9, wherein gaming machines are configured to operate with the controller to reset the accumulated award to a designated range of a plurality of numbers of plays of the free games upon the occurrence of the triggering event.

17. The gaming system of claim 9, wherein the gaming machines are configured to operate with the controller to increment the accumulated award based on a percentage of wagers made on plays of the wagering game at one of the gaming machines.

18. The gaming system of claim 9, wherein the gaming machines are configured to operate with the controller to increment the accumulated award based on a percentage of wagers made on plays of the wagering game at a plurality of the gaming machines.

* * * * *

UNITED STATES PATENT AND TRADEMARK OFFICE

CERTIFICATE OF CORRECTION

PATENT NO. : 8,491,390 B2
APPLICATION NO. : 13/242010
DATED : July 23, 2013
INVENTOR(S) : Karen Michelle Cregan It is certified that error appears in the above-identified patent and that said Letters Patent is hereby corrected as shown below:

IN THE CLAIMS

In Claim 9, Column 41, Lines 37 to 38, between “machines” and “play” insert --to--.
In Claim 16, Column 42, Line 28, between “wherein” and “gaming” insert --the--.

Signed and Sealed this
Eighteenth Day of February, 2014

Michelle K. Lee

Michelle K. Lee
*Deputy Director of the United States Patent and Trademark Office*